US005282136A

United States Patent [19]

Zui et al.

[11] Patent Number: 5,282,136

[45] Date of Patent: Jan. 25, 1994

[54] VERTICAL RELEASING CONTROL DEVICE OF CRANE HANGING LOAD

[75] Inventors: Hiroshi Zui, Kobe; Hideaki Yoshimatsu, Akashi; Eiko Hirooka; Koichi Fukushima, both of Kobe, all of Japan

[73] Assignee: Kabushiki Kaisha Kobe Seiko Sho, Kobe, Japan

[21] Appl. No.: 677,337

[22] Filed: Mar. 29, 1991

[30] Foreign Application Priority Data

Mar. 30, 1990 [JP] Japan ..... 2-86202
Jan. 17, 1991 [JP] Japan ..... 3-3818

[51] Int. Cl.[5] ..... B66C 13/22; B66C 23/00

[52] U.S. Cl. ..... 364/424.07; 212/150; 212/155; 340/685

[58] Field of Search ..... 364/424.07; 340/685; 212/150, 153, 155, 149

[56] References Cited

U.S. PATENT DOCUMENTS

| | | | |
|---|---|---|---|
| 4,185,280 | 1/1980 | Wilhelm | 340/685 |
| 4,368,824 | 1/1983 | Thomasson | 212/150 |
| 4,395,706 | 7/1983 | Garber | 340/685 |
| 4,752,012 | 6/1988 | Juergens | 340/685 |
| 4,815,614 | 3/1989 | Putkonen et al. | 212/153 X |
| 4,910,673 | 3/1990 | Narisawa et al. | 364/424.07 |
| 5,034,892 | 7/1991 | Saotome | 364/424.07 |
| 5,160,056 | 11/1992 | Yoshimatsu et al. | 212/155 |

FOREIGN PATENT DOCUMENTS

| | | |
|---|---|---|
| 2534631 | 2/1977 | Fed. Rep. of Germany . |
| 3335402 | 4/1985 | Fed. Rep. of Germany . |
| 2050294 | 1/1981 | United Kingdom . |

*Primary Examiner*—Thomas G. Black
*Assistant Examiner*—Collin W. Park
*Attorney, Agent, or Firm*—Oblon, Spivak, McClelland, Maier & Neustadt

[57] ABSTRACT

For use where a hanging load 81 is vertically hung and released with a crane having either a jib or a boom which can be raised or lowered, or where a long hanging load 81 is raised from its lowered state to its vertical state so as to be hung-up and released a control device of the has a control section for performing automatically the raising of the jib 60 or boom 61 and the winding-up or -down of the winding-up rope 70, in cooperation with each other in response to their initial states. In case that the initial angle of the jib or boom is large or small, it is controlled in such a way as a rate of variation of the hanging load ΔT applied to the winding-up rope 70 becomes constant. It positions the extreme end of the jib or boom on the vertical line passing through a center of gravity of the hanging load. With such a control device, the handing load is not oscillated and a smooth vertical releasing is carried out. An entire long hanging load 81 is vertically hung up and released from the ground after its vertical releasing without displacing the position of the other end from its lowered state.

11 Claims, 13 Drawing Sheets

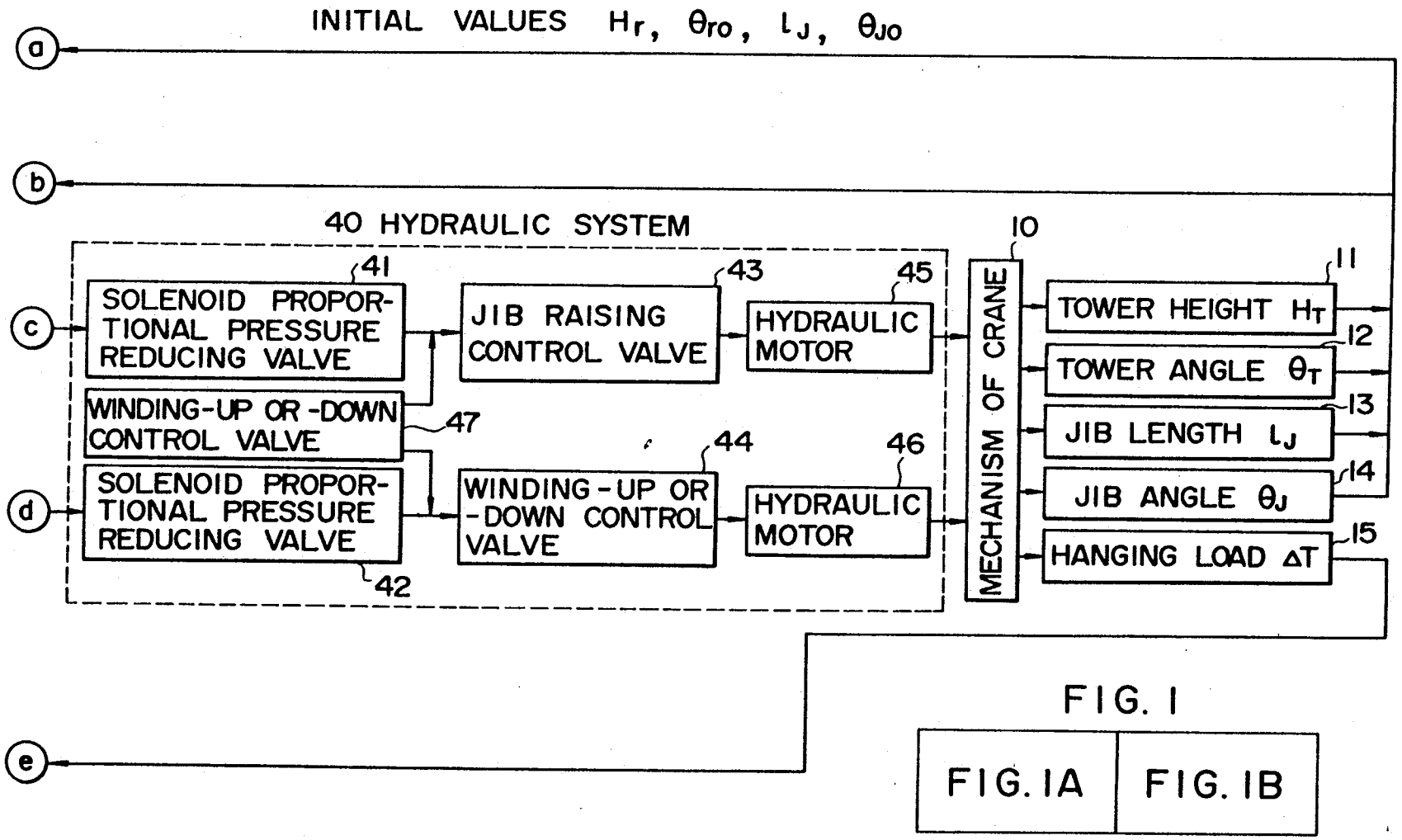
FIG. 1B
INITIAL VALUES Hr, θro, LJ, θJo
a
b
c
d
e
40 HYDRAULIC SYSTEM
SOLENOID PROPORTIONAL PRESSURE REDUCING VALVE
41
WINDING-UP OR -DOWN CONTROL VALVE
47
SOLENOID PROPORTIONAL PRESSURE REDUCING VALVE
42
JIB RAISING CONTROL VALVE
43
WINDING-UP OR -DOWN CONTROL VALVE
44
HYDRAULIC MOTOR
45
HYDRAULIC MOTOR
46
MECHANISM OF CRANE
10
TOWER HEIGHT HT
11
TOWER ANGLE θT
12
JIB LENGTH LJ
13
JIB ANGLE θJ
14
HANGING LOAD ΔT
15
FIG. 1
FIG. 1A
FIG. 1B

VERTICAL RELEASING CONTROL DEVICE OF CRANE HANGING LOAD

BACKGROUND OF THE INVENTION

1. Field of the Invention

This invention relates to a control device of a crane having a jib or a boom which can be raised for use in winding up a hanging load in a vertical direction to release it from a ground and more particularly a control device of a vertical releasing for preventing the load from being vibrated during its releasing from the ground.

2. Description of the Prior Art

As already disclosed in the specification of Jap.Pat.-Publn. No.Sho 59-26599, in case that a load is wound up by a winding-up rope hung from an extreme end of a jib in a crane provided with the jib which can be raised freely, the extreme end of the jib is coincided with a vertical line passing through a center of gravity of the hanging load. However, after this operation, as the winding-up rope is wound up, the jib or the like is flexed, resulting in that the extreme end of the jib is displaced in a forward direction from upon the vertical line. In this way, as only the winding-up rope is wound up while the extreme end of the jib or the like is being displaced, the hanging load is moved in a foreward direction just when the hanging load is released from the ground (the load is released from the ground), resulting in forming a load oscillation.

In the specification of the aforesaid Jap.Pat.Publn-.No. Sho 59-26599 is disclosed the following control means in order to prevent the load from being oscillated when the load is released from the ground as described above. That is, an energizing torque instruction signal varying in a step-wise manner as a time elapses is outputted from a winding-up energization torque instruction device on the basis of a difference between a speed instruction value outputted from the winding-up instruction device and a speed sensing value of a winding-up electric motor and then a winding-up speed of the winding-up rope is feed back controlled in response to the instruction signal. In turn, an amount of flexing of the jib is instructed from the flexing amount instruction device in response to a momentum of the jib, a raising speed is outputted from the jib raising amount instruction device in response to the flexing amount and the aforesaid winding-up speed instruction signal, and the jib raising speed is feed back controlled in response to a difference between the speed instruction and a rotational speed sensing value of the jib raising electric motor. In this way, a displacement of the extreme end in a forward direction is corrected by raising the jib.

The aforesaid control means has the following problems.

A. Since a driving torque instruction for winding-up the hanging load is increased in a stepwise manner, a hanging load winding-up speed is substantially varied when the operating steps are varied and a transient oscillation may easily be produced. It takes much time until the releasing operation is finished as compared with the case in which the hanging load winding-up speed is continuously increased.

B. In order to minimize a load oscillation during the releasing of the load from the ground, it is necessary to control a position of the extreme end of the jib in such a way as the position of the extreme end of the jib always occupies just above the vertical line of the hanging hook. However, in case of the aforesaid control means, a retracting speed of the jib is correspondingly controlled in response to the winding-up speed of the hanging load, an accurate position control of the extreme end of the jib may not be carried out and there is no assurance that the extreme end of the jib always lies just above the hanging load just when the load is released, resulting in that is it hard to make a positive prevention of the load oscillation.

C. Although the aforesaid control means calculates a flexing amount of the extreme end of the jib in response to a momentum of the jib and controls a raising speed of the jib in response to the flexing amount, the flexing amount is not determined only with the momentum. That is, even with the same momentum, the flexing amount is varied in response to an initial jib angle or a jib length or the like. For example, in case that the jib initial angle is low, if the jib is raised, a tension applied to the winding-up rope is rapidly increased due to a large displacement amount toward the vertical upward direction as compared with a horizontal displacement amount of the extreme end of the jib, resulting in that the hanging load is released before the forward horizontal displacement amount of the extreme end of the jib is corrected. In order to prevent this phenomenon, it is necessary to raise the jib while the winding-up rope is wound down in such a way that a rate of variation of a rope tension force is kept at a specified limited value. However, in case of the aforesaid control means, the controlling operation is carried out in reference to the winding up of the winding-up rope, so that the winding-down control may not be carried out.

In turn, in the specification of Jap.Pat.Laid-Open No.Sho 62-191393 is disclosed another means differing from the aforesaid control means. The control means is operated such that in order to cause the position of the extreme end of the boom to be placed just above the vertical location of the hanging load through a single operation of the boom raising, a moving speed v ($v=L.\cos\theta.\Omega$) of the extreme end of the boom in a vertical direction produced under the boom raising operation is calculated in response to a boom length L, a cosine value of a boom raising angle $\theta$ and a boom raising angular speed $\Omega$, the speed v is applied as a moving speed instruction value of the winding-up rope, and the moving speed of the winding-up rope is controlled by a servo control device in such a way as a difference between the instruction value and the detected value of the moving speed of the winding-up rope becomes zero.

In case of this control means, in order to correct a position of the extreme end of the boom displaced by the raising operation of the boom, the moving speed of the winding-up rope is controlled so as to keep a rate of variation of a tension of the rope constant. A mere control of the moving speed of the winding-up rope is difficult to perform an accurate position control of the extreme end of the boom, it may happen that the hanging load is released from the ground while the extreme end of the boom is being displaced from the vertical line passing through a center of gravity of the hanging load and so it is difficult to make a positive prevention of the load oscillation.

In the specification of Jap.Pat.Laid-Open No.Sho 61-211296 is disclosed means for controlling a winding-up speed of the winding-up rope and a jib raising speed in order to prevent a load oscillation during a widing-up of the winding-up rope in such a way as an oscillation angle of the winding-up rope in respect to the vertical line is detected and its oscillation angle becomes a set value. However, with such a control means, it is difficult to make an accurate detection of the oscillation angle of the winding-up rope. Due to this fact, a control over each of the speeds described above becomes inaccurate and the load oscillation may not be positively prevented.

Each of the aforesaid well-known control means is applied to a so-called round hanging object releasing operation in which the extreme end of the jib at its initial state, a hanging element for the extreme end of the winding-up roper and a center of gravity of the hanging load are coincided to each other. In case of hanging the round load, it is sufficient that only the displacement (a forward falling amount) of the extreme end of the jib caused by the flexing of the jib as the hanging load applied to the winding-up rope is increased is corrected.

To the contrary, in case that a long hanging load such as a column or a pile or the like is raised from its fallen (lowered) state to its vertical state to release from the ground, it is needed to perform a correction for displacing the extreme end of the jib by an amount corresponding to a length of the handing load in addition to a correction of the displacement of the extreme end of the jib in order to prevent a displacement of position of the hanging load or a load oscillation. In some cases, a correction in a swivelling direction is also required and then a three-dimensional correction of position is needed.

Each of the well-known control means may not perform an automatic correction of position. Due to this fact, in case that the long hanging load is to be released from the ground, it is actually performed that an operator raises the jib through his manual operation, winds up or winds down the winding-up rope in response to a signal from a load hanging person or in reliance upon his experience and operational guess-feeling while looking at the hanging load (in some cases, also its swivelling action).

In case that the long hanging load is mounted in a longitudinal (an aft and fro) direction as viewed from the operator, it is needed to perform a substantial correction of the position of the extreme end of the jib in its aft and fro direction as the hanging load is changed from its fallen state to its raising state. In this case, it is difficult for the operator to get a degree of inclination of the aft and fro directions of the hanging load and the jib, an efficiency in operation is poor under the aforesaid manual operation, a fine adjustment of the position of the extreme end of the jib in an aft and fro direction is difficult and so an accurate control of the position may not be attained. Due to this fact, a position of the hanging load is sometimes displaced before releasing it from the ground or the hanging load is widely oscillated forwardly and rearwardly just when the releasing from the ground is carried out. However, a displacement in position of a certain hanging load is not always allowed and a substantial oscillation of the hanging load is dangerous.

SUMMARY OF THE INVENTION

It is an object of the present invention to provide a control deice for a vertical releasing of a hanging load in which the hanging load can be released from a ground automatically and smoothly under a continuous operation only with an instruction of the starting of the releasing of the hanging load when the hanging load is hung up by a tower crane provided with a raising jib at an extreme end of the tower, or a jib crane having a raising jib at an extreme end of a boom.

It is another object of the present invention to enable to improve an accuracy in controlling a releasing operation when a hanging load is hung, to correct accurately a position of the extreme end of the jib to its initial position under a control suitable for its initial position whatever the extreme end of the jib or the like may be varied from its initial position, and to prevent positively the load oscillation and to enable a smooth releasing of the load to be attained.

It is a still further object of the present invention to provided a control device for a vertical releasing of a hanging load which can prevent a load oscillation in the same manner as above and can release the load smoothly when the hanging load is hung up with a self-running type crane provided with a raising boom.

It is a further object of the present invention to provide a control device for a vertical releasing of a long hanging load capable of performing a vertical releasing by automatically raising the long hanging load from its fallen state under a continuous operation when one end of the long hanging load is held and hung up with the aforesaid crane.

It is still further object of the present invention to provide a control device for a vertical releasing of a long hanging load which can provide a positive prevention of a displacement of a position of the other end of the hanging load or a load oscillation when a central hanging load is released from the ground, improve safety and substantially improve working efficiency.

The vertical releasing control device for a hanging load of the present invention is applied to a crane having a raising jib, a jib raising driving device, a hanging load winding-up rope and a winding-up or -down driving device for a winding-up rope. The control device of the present invention includes means for sensing a position of the extreme end of the jib; means for sensing a hanging load; a releasing control starting instruction means; a target value calculating means for calculating a target value of a jib raising speed and a target value of a winding-up or -down speed of the winding-up rope in response to an initial value of a position of the extreme end of the jib detected by the jib extreme end position sensor means in response to an input of the releasing control starting instruction signal; a first calculation means for outputting a feed-forward control signal for raising a jib in response to a jib raising speed target value calculated by the aforesaid target value calculating means; and a second calculation means for outputting a feed-forward control signal for winding-up or -down of the winding-up rope in response to a winding-up or -down speed target value of the winding-up rope calculated by the aforesaid target value calculating means. The control means is further provided with a third calculation means for determining an amount of displacement of a position of the extreme end of the jib in response to a sensed value of the jib extreme end position by sensor means, setting its amount of displacement as a difference and outputting a jib raising feedback control signal for performing a position control of the extreme end of the jib in such a manner that its difference may become zero; a fourth calculation means for determining an amount of variation of the hanging load per unit time in response to a detected value of the aforesaid hanging load sensor means and outputting a feed-back control signal for winding-up or -down the winding-up rope in such a way as a difference between the amount of variation and the set value becomes zero; and a control means for controlling a driving of a jib raising driving device and the winding-up rope winding-up or -down driving device in response to a control signal outputted from each of the aforesaid calculation means.

With such an arrangement as described above, if the releasing control starting instruction means is operated after setting the jib to its initial position where the extreme end of the jib (or boom) is positioned on a vertical line passing through a center of gravity of a hanging load, the initial position of the extreme end of the jib (or the boom) is detected, then a jib raising speed target value in response to the initial position and the widing-up rope winding-up or -down speed target value are calculated. Each of the raising of the jib and either the winding-up or winding-down of the winding-up rope is smoothly carried out under a feed-forward control in response to these target values. In addition, a position of the extreme end of the jib is accurately controlled in such a way as the extreme end of the jib is returned rapidly to its initial position under a feed-back control while a varying state of an actual initial position of the extreme end of the jib is being approached in cooperation with this feed-forward control. Further, it is feed-back controlled in such a way that a rate of variation of the hanging load becomes constant while the hanging load is being sensed in cooperation with the position control for the extreme end of the jib. In this way, a feed-forward control and a feed-back control having a result of feed-forward control as its difference are carried out for both jib raising and either a winding-up or winding-down of the winding-up rope, and a position control for the extreme end of the boom and a control for an increased amount of the hanging load are cooperatively carried out, thereby an accuracy in controlling the releasing operation is improved. Accordingly, irrespective of the initial position of the extreme end of the jib (a size of the initial angle) and even if a value of the hanging load is not apparent, the hanging load is released from the ground in a vertical direction under an automatic and continuous operation and then the load oscillation is positively prevented.

The control device of the present invention has a jib angle detector acting as sensor means for sensing a position of the extreme end of the jib. The aforesaid target value calculation means may calculate a winding-up speed target value for winding-up the winding-up rope at a speed corresponding to the initial value of jib angle when the initial value of the jib angle detected by the jib angle detector is larger than a set value, and calculate the winding-down speed target value for winding-down the winding-up rope at a speed corresponding to the initial value of the jib angle when the initial value is less than the set value.

With such an arrangement, when the initial position of the jib is less than a set value, the winding-up rope is wound down, thereby a rapid increasing of a rope tension can be prevented and this a releasing of the hanging load can be positively prevented before an amount of horizontal displacement of the extreme end of the jib is corrected. When the initial position of the jib is larger than the set value, the winding-up rope is wound up, thereby an increased amount of tension of the winding-up rope can be prevented from being rapidly decreased and thus a fast releasing of the load can be performed within a target time.

The control device of the present invention is provided with a signal processing means for restricting a maximum value and a minimum value of each of the feed-forward control signals outputted from the aforesaid first and second calculation means.

A maximum value and a minimum value of a feed-forward control signal for each of the jib raising and the winding-down of the winding-up rope inputted from the aforesaid first and second calculation means are restricted by a signal processing means, these control signals are restricted to be included within their most appropriate range, thereby a tension force applied to the winding-up roper is prevented from being rapidly increased to release the load from the ground, an increasing amount of the rope tension is prevented from being too decreased and delayed, resulting in that the releasing of the load from the ground can always be performed while it is being kept at its most appropriate state and an increased efficiency of operation can be assured.

The control device of the present invention is provided with a signal processing means for gradually increasing a rising pattern of each of the feed-forward control signals outputted from the first and second calculation means from each of the reference values (zero) to a target control value within a set time.

With such an arrangement as one in which a control signal of the aforesaid feed-forward is gradually increased along with a predetermined rising pattern, it is possible to prevent an occurrence of rapid shock to the jib or the like when the releasing control is started, and a quite smooth control over the releasing can be started.

The control device of the present invention is provided with a differentiator for differentiating an amount of variation of a hanging load detected by a hanging load sensor means with time; a releasing finish discrimination means for discriminating if the releasing control is finished or not in response to whether the time differentiated value is within a set range during a set time; and a control stop instruction means for outputting a control stop signal for each of the aforesaid driving devices in response to a finish signal from the discriminating means.

A finishing time of the releasing operation can be automatically discriminated under an arrangement of a time differentiator for an amount of variation of the aforesaid hanging load and a releasing finish discriminator, each of the driving devices can be automatically stopped to finish the releasing operation and then a useless movement can be eliminated.

The control device of the present invention is provided with a signal processing means for gradually decreasing a control signal for each of the aforesaid driving devices from its controlled value to a reference value (zero) within a set time in response to a control stop signal from the control stop instruction means.

With such an arrangement in which a control signal for each of the driving devices is gradually decreased by the aforesaid signal processing means along with a predetermined stop pattern, it is possible to prevent a rapid shock from being generated upon finishing of a releasing control and further the releasing control can be finished quite smoothly.

The control device of the present invention is constructed such that the jib is supported on an upper end of a tower in such a way as it may be raised, a jib extreme end position sensor is composed of each of the sensors for a tower height, a tower angle, a jib length and a jib angle, and then the jib extreme end position is calculated in response to the sensed values of each of these sensors.

In case that the present invention is applied to the aforesaid tower crane, it is not necessary to arrange an angle sensor or the like, as a sensor of an over-load preventing device set in general in the crane is utilized so as to enable a controlling operation to be performed and easily carried out.

The control device of the present invention is constructed such that it has a hydraulic motor for driving a winding-up drum for a jib raising rope as a jib raising driving device, it has a hydraulic motor for driving a take-up drum for the winding-up rope as a winding-up rope winding-up or -down driving device, it has as the aforesaid control means a control valve for controlling a flowing flow rate of hydraulic oil from a hydraulic source to each of the hydraulic motors, and it has a solenoid proportional pressure reducing valve for outputting a hydraulic signal for controlling a change-over of each of the control valves in response to each of the aforesaid control signals.

With such an arrangement as above, the present invention may be applied to a hydraulic driving type crane in which a jib raising and a winding-up or -down the winding-up rope are carried out by a hydraulic motor. In this case, a fine control may also be performed under a combination of the solenoid proportional pressure reducing valve and a control valve and then a releasing control can be smoothly performed.

The control device of the present invention is constructed such that the jib is a boom supported on an upper swivelling body of a crane in such a way as it may be raised, a sensor means for a jib extreme position is composed of a boom length sensor and a boom angle sensor, and then the boom extreme end position is calculated in reference to the boom length and the boom angle detected by each of the aforesaid sensors.

In this way, even if the jib is a boom supported on the upper swivelling body of a crane in such a way as it may be raised, in particular, an expandable or retractable boom, a control of the releasing can be performed and also in this case an existing sensor can be utilized to perform a controlling operation and it may easily be carried out.

The control device of the present invention is constructed such that it has a boom raising hydraulic cylinder as a jib raising driving device, it has a hydraulic motor for driving a take-up drum for the winding-up rope as a winding-up rope winding-up or -down driving device, and it has a control valve for controlling a flowing flow rate of hydraulic oil from a source of hydraulic oil to the aforesaid hydraulic cylinder and the hydraulic motor and has a solenoid proportional pressure reducing valve for outputting a hydraulic signal for use in controlling a change-over of each of the control valves in response to each of the aforesaid control signals.

With such an arrangement as above, the device of the present invention may be applied to the crane for raising the boom with a hydraulic cylinder and also in this case a fine control can be performed under a combination of the solenoid proportional pressure reducing valve and a control valve, and a smooth control of the releasing can be performed.

In addition, the control device of the present invention may be applied to the case in which one end of the long hanging load is hung and the hanging load is raised from its fallen state vertically to perform a releasing operation. In this case, the control device of the present invention has means for calculating an amount of winding-up or -down of the winding-up rope to calculate each of a first widing-up or -down amount of the winding-up rope at the first step for vertically releasing one end while the other end of a long hanging load is being positioned at a specified position, a second winding-up or -down amount of the winding-up rope at the second step for raising the long hanging load to position one end over the other end in a vertical upper part while the other end of the long hanging load being positioned at the specified position upon completion of the first step, and a third amount of winding-up or -down of the winding-up rope at the third step to release the other end in a vertical direction while one end of the long hanging load being positioned vertically over the other end upon completion of the second step. In addition, the control device of the present invention is provided with a jib raising amount calculating means for calculating a first amount of raising of the jib for correcting a displacement of the extreme end of the jib caused by a flexing of the jib at the aforesaid first step and positioning the jib extreme end over one end of the long hanging load in a vertical upper direction, a second amount of raising of jib for displacing the jib extreme end at the second step by a horizontal distance from one end of the long hanging load to the other end of the load and a third raising amount for correcting a displacement of the jib extreme end caused by a flexing of the jib at the third step and positioning the jib extreme end over the long hanging load in a vertical direction; a winding-up rope winding-up or -down control means for driving and controlling the winding-up or -down driving device for the winding-up rope in response to each of the winding-up or -down amounts calculated by the aforesaid winding-up or -down amount calculating means; and a jib raising control means for driving and controlling the jib raising driving device in response to each of the raising amounts calculated by the aforesaid jib raising amount calculating means.

With such an arrangement as above, the jib is not only the jib supported at the extreme end of the tower or the extreme end of the boom in such a way as it may raised, but also a boom supported in the main body of the crane in such a way as it may be raised.

With such an arrangement as above, one end of the long hanging load is released vertically while the other end of the long hanging load is kept at its specified position at the first step and then the long hanging load is raised vertically while the extreme end of the jib is always controlled for its position in a vertical upper direction with the other end of the long hanging load being kept at its specified position at the second step and lastly the other end, i.e. an entire long, hanging load is released in a vertical direction while one end of the long hanging load being positioned over the other end at the third step in a vertical direction. Accordingly, the position of the long hanging load is not displaced at each of the afore-said steps, the load is not oscillated, the long hanging load is automatically raised from its fallen state under a continuous operation and a smooth releasing operation is performed. With such an arrangement, it is possible to improve a safety and an operating efficiency substantially as well.

BRIEF DESCRIPTION OF THE DRAWINGS

FIG. 1, 1A, and 1B illustrate a block diagram for showing a preferred embodiment of a vertical releasing control device for a hanging load of the present invention.

DESCRIPTION OF THE PREFERRED EMBODIMENTS

Figure 2:
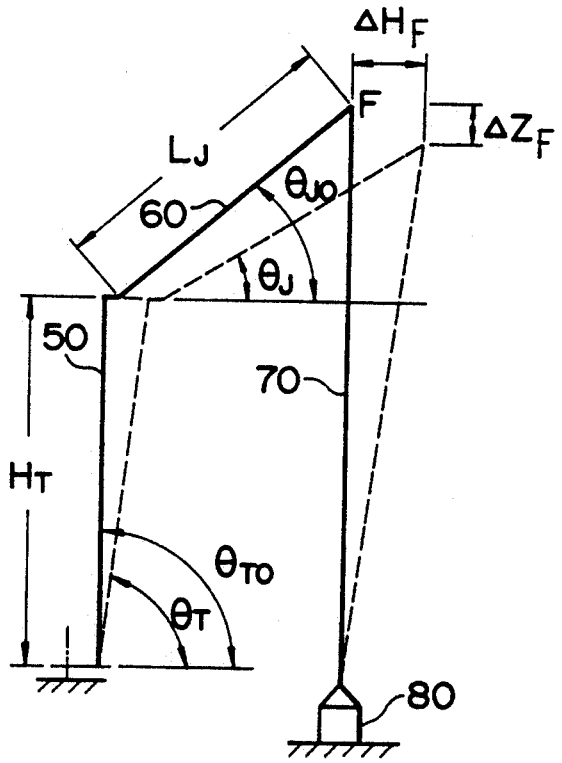
FIG. 2 is a schematic diagram for showing one example of a tower crane to which the present invention is applied.

FIG. 2 is a schematic illustration of a tower crane to which the present invention is applied. In FIG. 2, a jib 60 is supported on the upper end of a tower 50 in such a way as it may be raised. A hanging load 80 is supported in a winding-up rope 70 suspended from an extreme end F of the jib 60 (a top sheave). In case that the hanging load 80 is released from the ground in a vertical direction, as shown by a solid line in this figure, an extreme end F of the jib 60, an extreme end hook of a winding-up rope 70 and a center of gravity of the hanging load 80 are set in the same vertical line (an initial position).

As the hanging load 80 is wound up from an initial position shown by a solid line in FIG. 2 via the winding-up roper 70, a tension applied to the winding-up rope 70 is gradually increased. Along with this increasing tension, an extention of the jib raising rope or a flexing of a tower 50 and the jib 60 are generated and then the extreme end F of the jib 60 is displaced in a forward and lower direction as indicated by a broken line in FIG. 2.

An amount of horizontal displacement $\Delta H_F$ of the jib extreme end F is comprised of a displacement amount $\Delta H_T$ in a horizontal direction generated by an angular variation of the tower 50 and a displacement amount $\Delta H_J$ in a horizontal direction generated by an angular variation of the jib 60, and this is calculated by reference to the following equation (1). A vertical displacement amount $\Delta Z_F$ of the extreme end F of the jib in a vertical direction is calculated in reference to the following equation (2).

$$\begin{aligned} \Delta H_F &= \Delta H_T + \Delta H_J && (1) \\ &= H_T(\sin\theta_{T0} - \sin\theta_T) + L_J(\cos\theta_J - \cos\theta_{J0}) \\ \Delta Z_F &= L_J(\sin\theta_J - \sin\theta_{J0}) && (2) \end{aligned}$$

$H_T$: Tower Height
$L_J$: Jib Length
$\theta_{TO}$: Tower Initial Angle
$\theta_T$: Tower Angle
$\theta_{JO}$: Jib Initial Angle
$\theta_J$: Jib Angle $\Delta H_F$ has its forward displacement of "negative" and its rearward displacement of "positive", and $\Delta Z_F$ has an upward displacement of "positive" and a lower displacement of "negative".

As the jib 60 is raised in order to cause a horizontal displacement amount $\Delta H_F$ in a forward direction of the extreme end F of the jib to be zero, the extreme end F of the jib 60 is retracted in a horizontal direction and at the same time it is also pulled up on the vertical line. In this case, when the initial angle $\theta_{JO}$ of the jib 60 in particular is low, a vertical displacement amount $\Delta Z_F$ becomes large as compared with the horizontal displacement amount $\Delta H_F$ of the extreme end F of the jib generated by raising the jib 60, a tension of the winding-up rope 70 is rapidly increased and a releasing operation is carried out before correcting the aforesaid horizontal displacement amount $\Delta H_F$ and so there is a possibility that the load is oscillated. In turn, when the initial angle $\theta_{J0}$ of the jib 60 is large, the vertical displacement amount $\theta Z_F$ becomes low as compated with a horizontal displacement amount $\Delta H_F$ of the extreme end F of the jib generated by raising the jib 60, resulting in that a rate of increasing a tension of the winding-up rope 70 is reduced and a releasing time is extended.

The control device of the present invention is applied to prevent such a load oscillation as above and to perform an efficient vertical releasing of the hanging load 80.

Figure 1A:
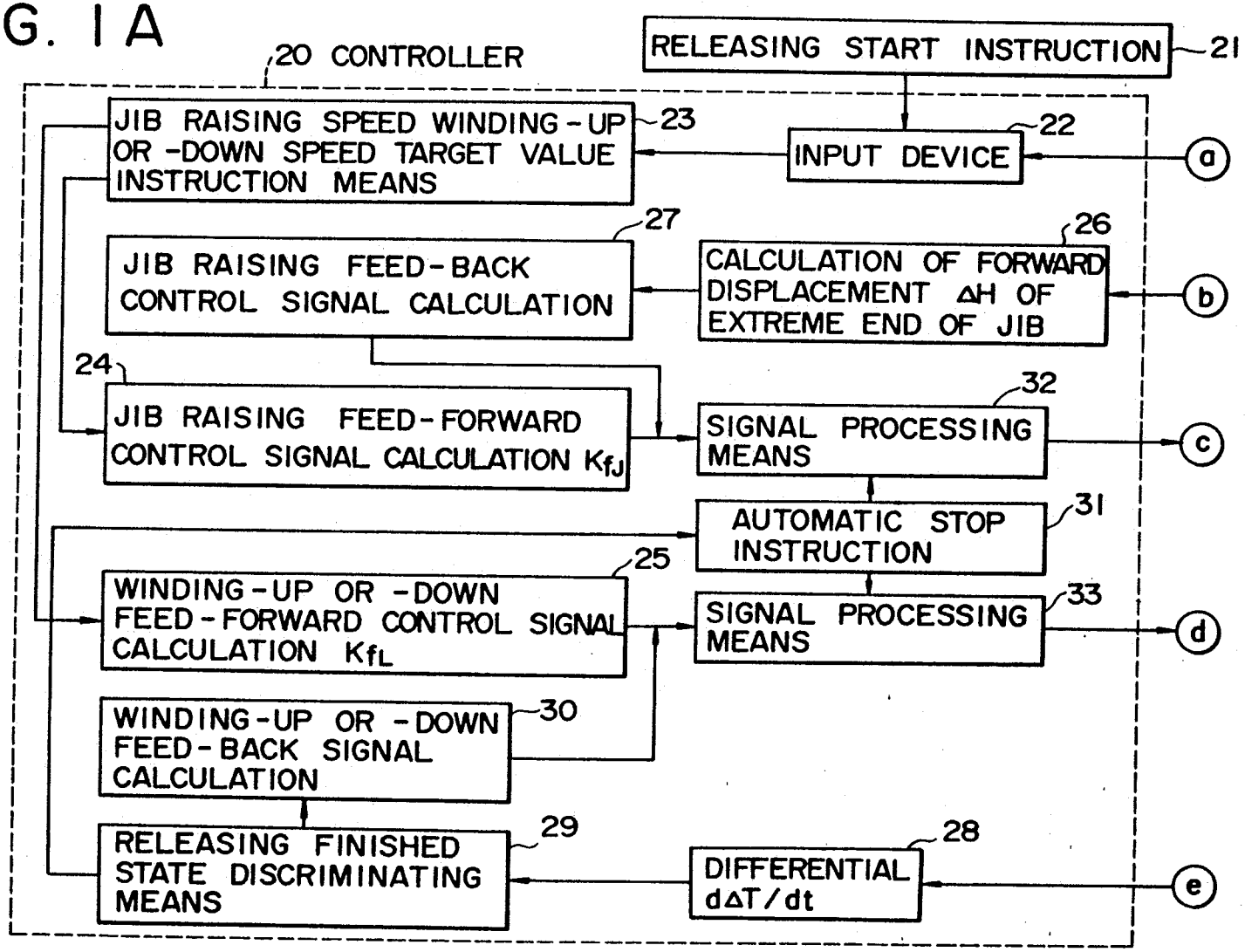

FIG. 1 is a block diagram for showing a preferred embodiment of the control device of the present invention. This control device is provided with a tower height sensor 11, a tower angle sensor 12, a jib length sensor 13 and a jib angle sensor 14 as a sensing means for detecting the extreme end F of the jib. Reference numeral 15 denotes a hanging load sensor and normally a load meter for sensing a tension applied to the winding-up rope 70 as a hanging load is utilized. Each of these sensors 11 to 15 is installed at a predetermined location in the crane 10, wherein in general, it is possible to utilize the sensor for an over-load preventing device installed in the crane 10. in case that the tower height $H_T$ and the jib length $L_J$ are stored in a micro-computer, these memories can be used as setting units. Reference numeral 20 denotes a controller, reference numeral 21 denotes a releasing control starting instruction switch and reference numeral 40 denotes a control means for a hydraulic system.

Then, a vertical releasing control for the hanging load will be described.

Feed-Forward Control

Tower height $H_T$, tower angle $\theta_T$, jib length $L_J$ and jib angle $\theta_J$ shown in FIG. 2 are detected by each of the aforesaid sensors 11 to 14, and these detected values are inputted to the aforesaid input device 22. In this case, as the releasing control starting switch 21 is turned on, its signal is inputted to the input device 22 of the controller 20 and at the same time the initial values $H_T$, $\theta_{T0}$, $L_J$ and $\theta_{J0}$ of the aforesaid detected values are inputted to a target value calculating means 23 through this inputting device 22.

The target value instructing means 23 may calculate the most appropriate value of raising speed of the jib 60 (see FIG. 3) and the most appropriate winding-up or -down speed L of the winding-up rope 70 (see FIG. 4) to perform a smooth vertical releasing of the hanging load 80 in reference to the initial position of the extreme end F of the jib 60, i.e. each of the aforesaid initial values $H_T$, $\theta_{T0}$, $L_J$ and $\theta_{J0}$. In this case, if the initial angle $\theta_{J0}$ of the jib 60 is larger than the set value, as shown in a solid line (a) in FIG. 4, a winding-up speed target value L0 for the winding-up of the winding-up rope 70 is calculated, and in turn, when the initial angle $\theta_{J0}$ of the jib 60 is less than the set value, it may calculate the winding-down speed target value −L0 for winding-down the winding-up rope 70 as shown at a solid line (b) shown in FIG. 4. The raising speed target value of the jib 60 is the most appropriate speed within a range in which the follow-up control for the winding-up or winding-down of the aforesaid winding-up rope 70 can be smoothly carried out.

Then, a feed-forward control signal $(EA)_{J0}$ multiplied by a gain $K_{fJ}$ is calculated by the first calculation means 24 in response to a jib raising speed target value calculated by the aforesaid target value calculating means 23, its control signal passes through a signal processing means 32 and is outputted to the solenoid proportional pressure reducing valve 41 of the control means in the hydraulic system. The solenoid proportional pressure reducing valve 41 may output a hydraulic signal (a pilot pressure) corresponding to a control signal from the aforesaid signal processing means 32, a spool stroke of a jib raising control valve 43 is controlled with its hydraulic signal, a flowing flow rate from the hydraulic source to the hydraulic motor 45 of the jib raising driving device is controlled and then a rotational speed of the hydraulic motor 45 is controlled. Thus, the raising of the jib 60 is carried out at the most appropriate target speed corresponding to the initial position of the extreme end F of the jib.

In turn, a feed-forward control signal $(EA)_{L0}$ multiplied by a regain $K_{FL}$ is calculated by the second calculation means 25 in response to a target value of the winding-up or -down speed of the winding-up rope 70 calculated by the aforesaid target value calculating means 23 together with the raising of the aforesaid jib 60, and then its control signal passes through the signal processing means 33 and is outputted to the solenoid proportional pressure reducing valve 42. The solenoid proportional pressure reducing valve 42 may output a hydraulic signal (a pilot pressure) corresponding to the control signal from the aforesaid signal processing means 33, a spool stroke of the control valve 44 for use in winding-up or -down the winding-up rope with the hydraulic signal, a flowing flow rate from the hydraulic source to the hydraulic motor 46 of a driving device for winding-up or -down the winding-up rope is controlled and a rotational speed of the hydraulic motor 46 is controlled. With such an arrangement, either the winding-up or -down of the winding-up rope 70 at the most appropriate target speed corresponding to the initial position of the extreme end F of the jib is carried out.

In this case, when the initial position of the jib 60, i.e. the initial angle $\theta_{J0}$ is less than a set value, although the vertical displacement amount $\Delta Z_F$ is increased as compared with the horizontal displacement amount $\Delta H_F$ of the extreme end F of the jib generated by the raising of the jib 60, the winding-down of the winding-up rope 70 is carried out in response to a winding-down speed target value of the winding-up rope 70 calculated by the target value calculating means 22 as described above, so that a tension of the winding-up rope 70 is prevented from being rapidly increased and there is no possibility that the hanging load 80 is released before the horizontal displacement amount $\Delta H_F$ of the extreme end F of the jib is corrected. In case that the initial angle $\theta_{J0}$ of the jib 60 is larger than the set value, the vertical displacement amount $\Delta Z_F$ is low as compared with the horizontal displacement amount $\Delta H_F$ of the extreme end F of the jib generated by the raising of the jib 60 and the winding-down of the winding-up rope 70 is carried out in response to the winding-up speed target value of the winding-up rope 70 calculated by the target value calculation means 22 as described above, so that a rate of increasing of a tension of the widing-up rope 70 is prevented from being extremely reduced.

Feed-Back Control

As the raising of the jib 60 caused by the aforesaid feed-forward control and either the winding-up or -down of the winding-up rope 70 are carried out, an extension of the jib raising rope or a flexing of the tower 50 and the jib 60 is produced and the extreme end F of the jib 60, i.e. the tower angle $\theta_T$ and the jib angle $\theta_J$ are gradually varied and at the same time a tension applied to the winding-up rope 70 is also gradually varied. Then, in order to make these variation values zero, the following feed-back control is carried out.

That is, the tower angle $\theta_T$ and the jib angle $\theta_J$ varying gradually and the predetermined tower height $H_T$ and the jib length $L_J$ are detected by the sensors 11 to 14, respectively, and these detected values are inputted to the displacement amount calculation means 26. An actual horizontal displacement amount $\Delta H_F$ of the extreme end F of the jib is calculated by the calculation means 26 in reference to the above equation (1) and then the horizontal displacement amount $\Delta H_F$ is inputted to the third calculator 27. The horizontal displacement amount $\Delta H_F$ is defined as difference and a feed-back control signal $(EA)_{BJ}$ corresponding to a required raising amount of the jib 60 multiplied by a proportional gain $K_{PJ}$ and an integrating gain $K_{IJ}$ so as to cause the difference $\Delta H_{FJ}$ to become zero is calculated. This control signal is inputted to the signal processing means 32.

Accordingly, to the signal processing means 32 are inputted the feed-forward control signal $(EA)_{fJ}$ and the feed-back control signal $(EA)_{BJ}$ and then the control signals calculated from both signals are inputted to the solenoid proportional pressure reducing valve 41. A hydraulic signal corresponding to the aforesaid control signals is outputted, a spool stroke (an opening area) of the jib raising control valve 43 is controlled by the hydraulic signal, a flowing flow rate for the hydraulic motor of the jib raising driving device is controlled and then a rotational amount of the hydraulic motor is controlled. Thus, the raising amount of the jib 60 is feed-back controlled in such a way as the horizontal displacement amount $\Delta H_F$ at each of the time of the extreme end F of the jib 60 generated under the aforesaid feed-forward control and an accurate position is controlled in such a way as the extreme end F of the jib 60 is returned to its initial position.

In turn, during this controlling period, a tension applied to the winding-up rope 70 is sequentially detected by a hanging load sensor 15 such as a load meter or the like. This detected value is gradually varied until an end of the releasing operation, and upon completion of the releasing operation, this value does not vary and finally it becomes a value corresponding to the hanging load, i.e. it becomes constant. Accordingly, even though the hanging of the load is not apparent, it can be judged that the tension of the winding-up rope becomes constant, i.e. a varying amount $\Delta T$ of the rope tension becomes a set value (zero) and the releasing operation is completed upon elapsing of a set time.

Then, in order to discriminate whether the releasing operation is completed or not, the tension of the winding-up rope 70 detected by the aforesaid hanging load detector 15 is inputted to a time differentiator 28, a time varying displacement amount $\Delta T$ of the aforesaid rope tension is differentiated at the time (t) by the time differentiator 28 ($d\Delta T/dt$) so as to get a varying amount of the rope tension per unit time. Then, the time differentiated value ($d\Delta T/dt$) is inputted to the releasing operation discriminating means 29 and it is discriminated whether the time differential value ($d\Delta T/dt$) is a releasing target value determined by the releasing target time or not.

In case that the aforesaid time differentiated value ($d\Delta T/dt$) is other than the releasing target value, it is discriminated that a difference $\Delta\Delta T$ between the aforesaid time differentiated value ($d\Delta T/dt$) and the target value is calculated by the fourth calculation means 30. The difference $\Delta\Delta T$ is multiplied by a proportional gain $K_{PL}$ and an integrating gain $K_{IL}$ to calculate a feed-back control signal $(EA)_{BL}$ for use in winding-up or -down the winding-up rope 70 and then the control signal $(EA)_{BL}$ is inputted to the signal processing means 33. Also in this case, to the signal processing means 33 are inputted the aforesaid feed-forward control signal $(EA)_{fL}$ and the feed-backcontrol signal $(EA)_{BL}$, and the control signals calculated from both signals are inputted to the solenoid proportional pressure reducing valve 42. A hydraulic signal corresponding to the aforesaid control signal is outputted from the pressure reducing valve 42, a spool stroke (an opening area) of the control valve 44 for use in winding-up or -down the winding-up rope is controlled by the hydraulic signal, a flowing flow rate for the hydraulic motor 46 of the winding-up rope winding-up or -down driving device is controlled, and a rotational amount of the hydraulic motor 46 is controlled. With such an arrangement, a winding-up or winding-down amount of the winding-up rope 70 is feed back controlled in such a way as the time differentiated value of the varying amount $\Delta T$ of a tension ($d\Delta T/dt$) applied to the winding-up rope 70 generated under the aforesaid feed-forward control may become a releasing target value, i.e. the rope tension force becomes constant.

As described above, the target value of raising speed of the jib 60 and the target value of the winding-up or feeding out speed of the winding-up rope 70 are defined in response to an initial position of the extreme end F of the jib 60, in particular the initial angle $\theta_{J0}$ of the jib 60, and the raising of the jib 60 and the winding-up or -down of the winding-up rope 70 are cooperatively related to each other under a control of the feed-forward type in reference to these target values. In addition, the result of control is approached; a position of the extreme end F of the jib 60 is controlled under a feed-back control in such a way that the horizontal displacement amount $\Delta H_F$ of the extreme end F of the jib 60, as the tension force of the winding-up rope 70 is increased, becomes always zero and at the same time either a winding-up amount or a winding-down amount of the winding-up rope 70 is controlled in such a way that the tension of the winding-up rope 70 becomes constant thus after the jib extreme end F is rapidly and accurately returned back to its initial position, the hanging load is released in a vertical direction, a transient vibration or a load vibration is not produced and a smooth releasing operation can be carried out.

Upon completion of the releasing operation, the tension of the winding-up rope 70 becomes constant (substantially the same as the hanging load) and the time differentiated value ($d\Delta T/dt$) of the varying amount $\Delta T$ of the rope tension reaches the releasing target value. Then, it is judged by the releasing completion discrimination means 29 that the releasing is completed, a releasing control stop instruction signal is outputted to the signal processing means 32 and 33 from the discrimination means 29 through the automatic stop instruction means 34, a hydraulic signal of the solenoid proportional pressure reducing valves 34 and 35 becomes zero by the signal from the signal processing means 32 and 33, each of the control valves 43 and 44 is returned back to its neutral position, each of the hydraulic motors 45 and 46 is stopped and then the releasing operation is completed.

Figure 3:
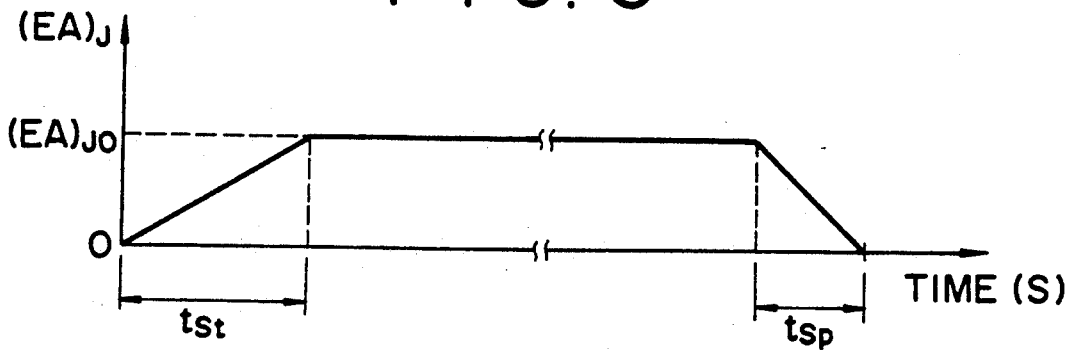
FIG. 3 is a view for showing one example of an output pattern of a feed-forward control signal for raising a jib.
Figure 4:
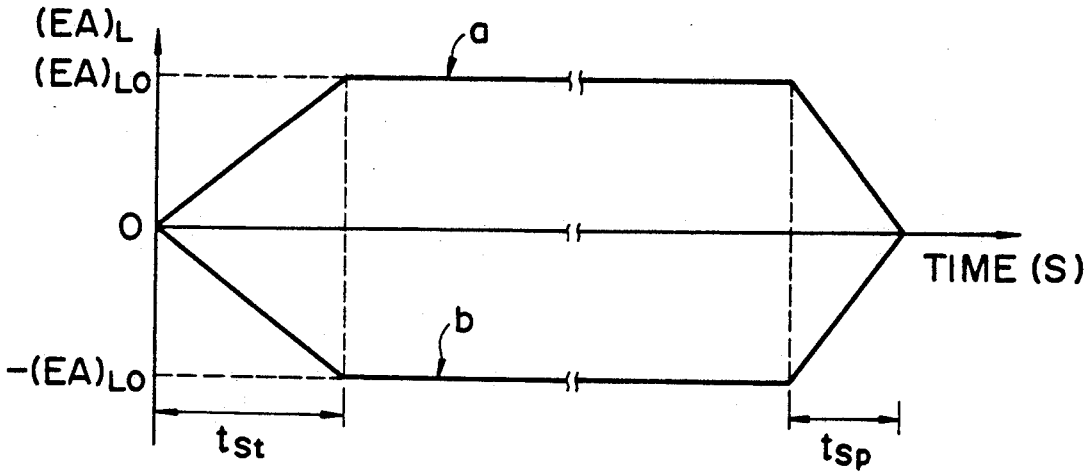
FIG. 4 is a view for showing one example of an output pattern of a feed-forward control signal for winding-up or -down a winding-up rope.

Under the aforesaid control, when the releasing operation is started, at first, a rising of the jib 60 and either the winding-up or -down of the winding-up rope 70 are carried out under a feed-forward control, so that it is preferable that a signal processing is carried out in such a way as each of the feed-forward control signals $(EA)_{J0}$ and $(EA)_{L0}$ for use in raising jib and winding-up or -down the winding-up rope outputted from the first and second calculation means 24 and 25 is gradually increased to get a controlled value within a predetermined raising time $t_{st}$ (for example, about 2 to 3 seconds) along a raising pattern shown in FIGS. 3 and 4 so as to prevent them from being rapidly operated. With such an arrangement, a rapid shock is not generated in the jib 60 or the like when the releasing control is started and then a smooth releasing control is started.

Figure 5:
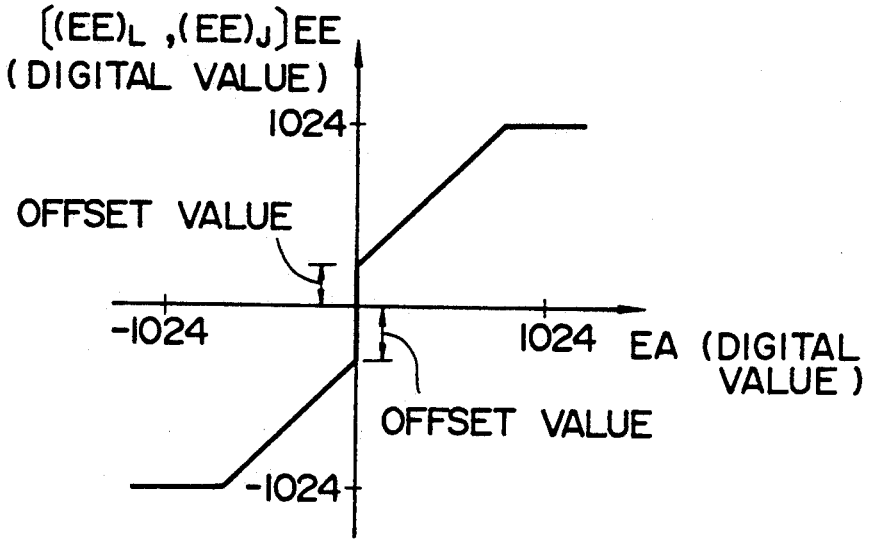
FIG. 5 is a graph showing a control signal before a non-linear accommodation and another control signal after a linear accommodation.

Since to the signal processing means 32 and 33 are inputted feed-forward control signals $(EA)_{J0}$ and $(EA)_{L0}$ and feed-back control signals $(EA)_{BJ}$ and $(EA)_{BL}$, the control signals $(EA)_J$ and $(EA)_L$ for the solenoid proportional pressure reducing valves 41 and 42 are calculated from these signals. In this case, there is a time gap in the hydraulic system from an output of the hydraulic signals from the non-sensitive zone i.e. the solenoid proportional pressure reducing valves 41 and 42 until the control valves 43 and 44 are opened to cause the oil to flow into the hydraulic motors 45 and 46. In order to correct this non-sensitive zone, the control signals $(EA)_J$ and $(EA)_L$ calculated from each of the aforesaid feed-forward control and the feed-back control are off-set processed in non-linear accommodation with a pre-determined off-set value as shown in FIG. 5 by the signal processing means 32 and 33 and they are outputted as control signals $(EE)_J$ and $(EE)_L$ after such non-linear accommodation.

Figure 6:
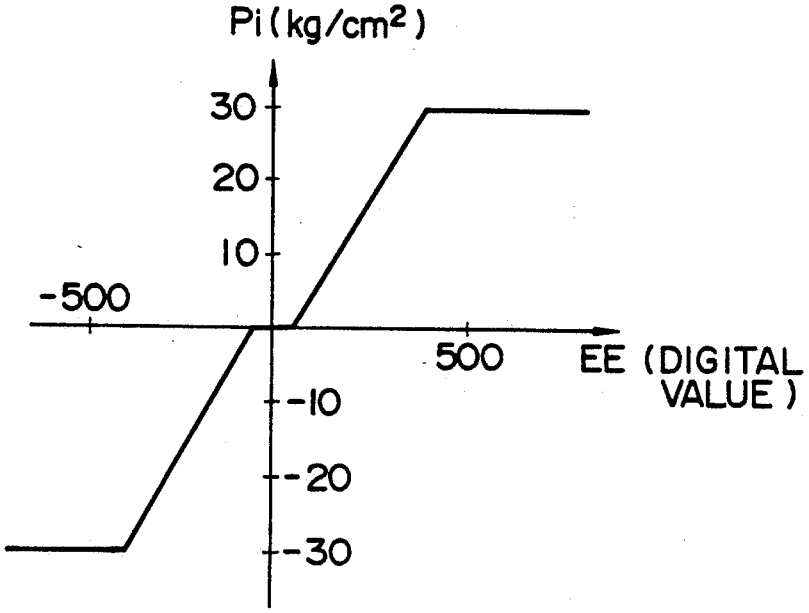
FIG. 6 is a relative diagram graph showing a control signal inputted to a solenoid proportional pressure reducing valve and a pilot pressure outputted from the pressure reducing valve.
Figure 7:
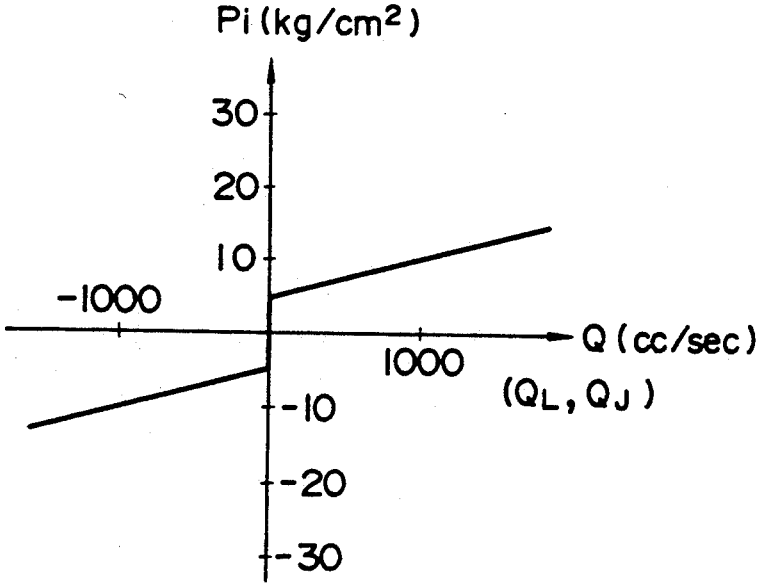
FIG. 7 is a graph of a pilot pressure versus a flowing flow rate for a hydraulic motor.

FIG. 6 is a view for showing a relation between the control signals $(EE)_J$ and $(EE)_L$ outputted from the signal processing means 32 and 33 and the hydraulic signals (pilot pressures) $Pi_J$ and $Pi_L$ outputted from the solenoid proportional pressure reducing valves 41 and 42. FIG. 7 is a view for showing a relation between the aforesaid pilot pressures $Pi_J$ and $Pi_L$ and flowing flow rates $Q_J$ and $Q_L$ for the hydraulic motor 45 for raising driving driving the jib 60 and the hydraulic motor 46 for driving a winch drum. Raising speed and raising amount for the jib 60 and winding-up (winding-down) speed and winding-up (winding-down) amount of the winding-up rope 70 are determined by the flowing flow rates $Q_J$ and $Q_L$.

In the aforesaid control, it is preferable that the maximum value and the minimum value of the feed-forward control signals for each of the raising of the jib 60, and winding-up or winding-down of the winding-up rope 70 inputted from the first and second calculation means 24 and 25 are restricted by the signal processing means 32 and 33 so as to prevent the varying amount (an increased amount) of the rope tension from being too much increased and to prevent a time required for performing a releasing operation from being too great, and these control signals are restricted to be within the most appropriate range.

Upon completion of the control of the releasing operation, if it is judged by the aforesaid discriminating means 29 that the releasing operation is completed, it is preferable that the stop pattern for gradually decreasing the feed-forward control signals $(EA)_{J0}$ and $(EA)_{L0}$ as shown in FIGS. 3 and 4 is set in the stop instruction means 31 so as to cause the raising speed of the jib 60 and the winding-up or -down speed of the winding-up rope 70 to become gradually zero within a specified time (for example, 1 to 2 seconds) at that time, the solenoid proportional pressure reducing valves 32 and 33 or the like are controlled in response to a signal got from the stop instruction means 31 and then the hydraulic motors 44 and 45 are gradually stopped. During this period, the feed-back control for the jib 60 is continued and the feed-back control for the winding-up rope 70 is stopped. With such an arrangement, upon completion of the releasing operation, there is no possibility that the jib 60 is raised due to its inertia or load oscillation or the like, the hanging load 80 does not bounce against the ground and a quite smooth releasing operation is completed.

During the aforesaid control, if the manual stop instruction means 47 such as an operating lever for a remote-controlled valve or the like, for example, is operated, each of the afore-said controls is immediately cancelled, each of the solenoid proportional pressure reducing valves 41 and 42 is operated in response to the operation of the aforesaid means 47 under a priority of manual operation, the control valves 43 and 44 are returned back to their neutral positions, the motors 45 and 46 are stopped. In this way, its safety is assured.

The device of the present invention is not limited to the tower crane of the aforesaid preferred embodiment, but it may also be applicable to a normal jib crane or a rafteren crane having an extendable or retractable boom or the like.

Figure 8:
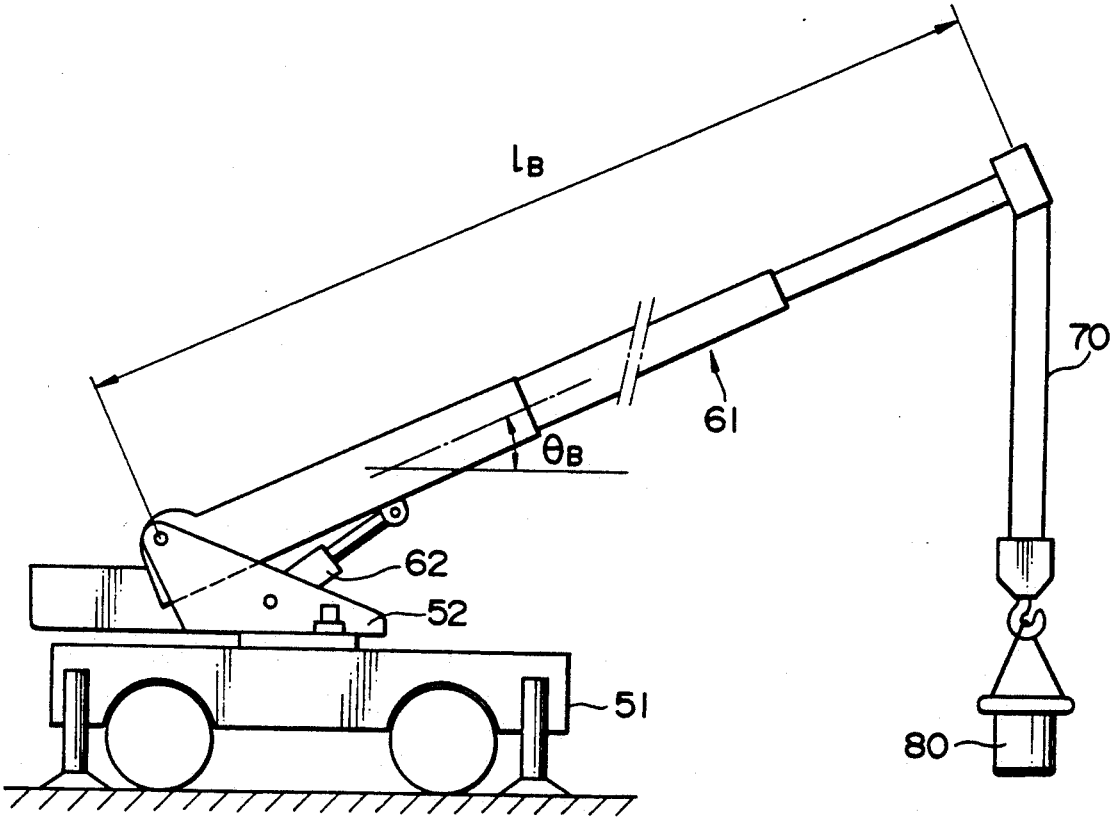
FIG. 8 is a side elevational view for showing one example of a rafteren crane to which the present invention is applied.
Figure 9:
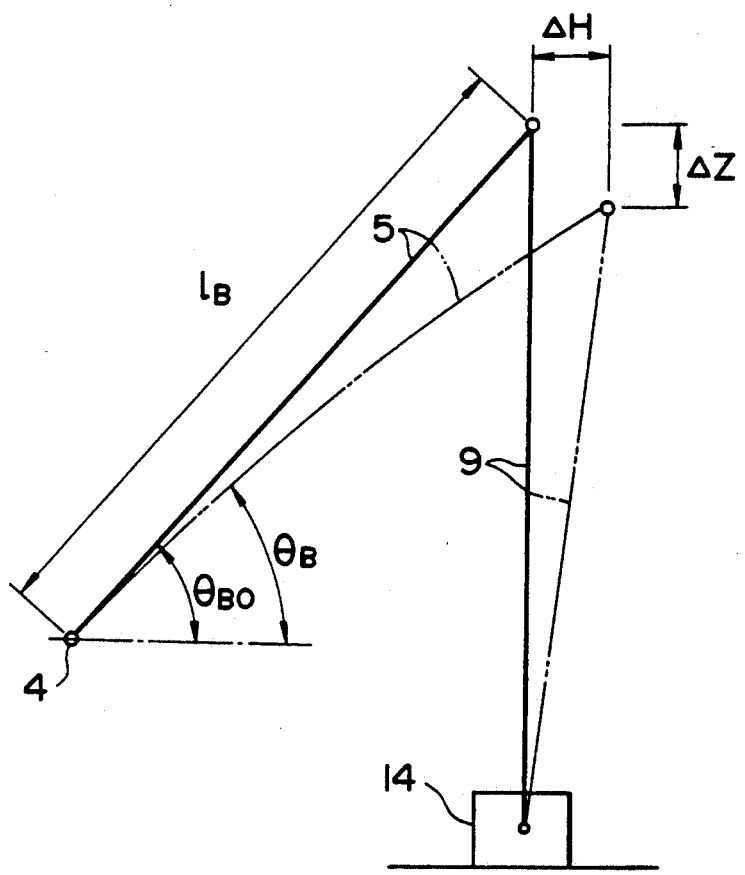
FIG. 9 is a schematic illustration for showing a flexed state of its boom.

FIG. 8 is a side elevational view for showing one example of the rafteren crane to which the device of the present invention is applied. FIG. 9 is a schematic view for showing a flexing state of an extendable or retractable boom of the rafteren crane. In FIGS. 8 and 9, an extendable or retractable boom 61 is supported through a boom raising hydraulic cylinder 62 on the upper swivelling body 52 rotatably arranged on a running vehicle 51 in such a way as it may be raised.

In case that a releasing control for the hanging load 80 is carried out with this rafteren crane, a working condition or a working attitude, i.e. the boom length $l_B$, boom angle $\theta_B$, hanging load applied to the winding-up rope 70 and a load-flexing characteristic curve corresponding to a swivelling angle or the like are stored in a memory device in advance, and when the releasing control is to be started, a position of the extreme end of the boom is calculated in response to each of the initial values $l_{B0}$, $\theta_{B0}$. . . of the boom length $l_B$, boom angle $\theta_B$, hanging load and swivelling angle detected by the boom length sensor, boom angle sensor, hanging load sensor and swivelling angle sensor and to a load-flexing characteristic curve stored in the aforesaid memory device and at the same time, a boom raising speed target value and a winding-up or -down speed target value of the winding-up rope corresponding to the position of the extreme end of the boom are calculated and subsequently the raising of the boom 61 and the winding-up or -down of the winding-up rope 70 are carried out under the same feed-forward control as above.

In addition, the horizontal displacement amount $\Delta H$ of the extreme end of the boom is calculated in response to the detected value varying in time detected by each of the aforesaid sensors and the aforesaid load-flexing characteristic curve, and subsequently, a position control of the boom 61 and a control of the winding-up or -down of the winding-up rope 70 are carried out under the same feed-back control as above and thus the hanging load 80 is released efficiently and smoothly. In this case, the load-flexing characteristic curve is applied, a raising of the boom 61 and the winding-up or -down of the winding-up rope 70 are cooperatively related to each other, the feed-forward and feed-back are controlled together, thereby an accuracy in controlling operation can be improved more as compared with that of each of the aforesaid prior art.

Then, a case in which the long hanging load 81 such as a column or a pile is raised by a crane from its fallen state to its vertical orientation will be described.

Figure 10:
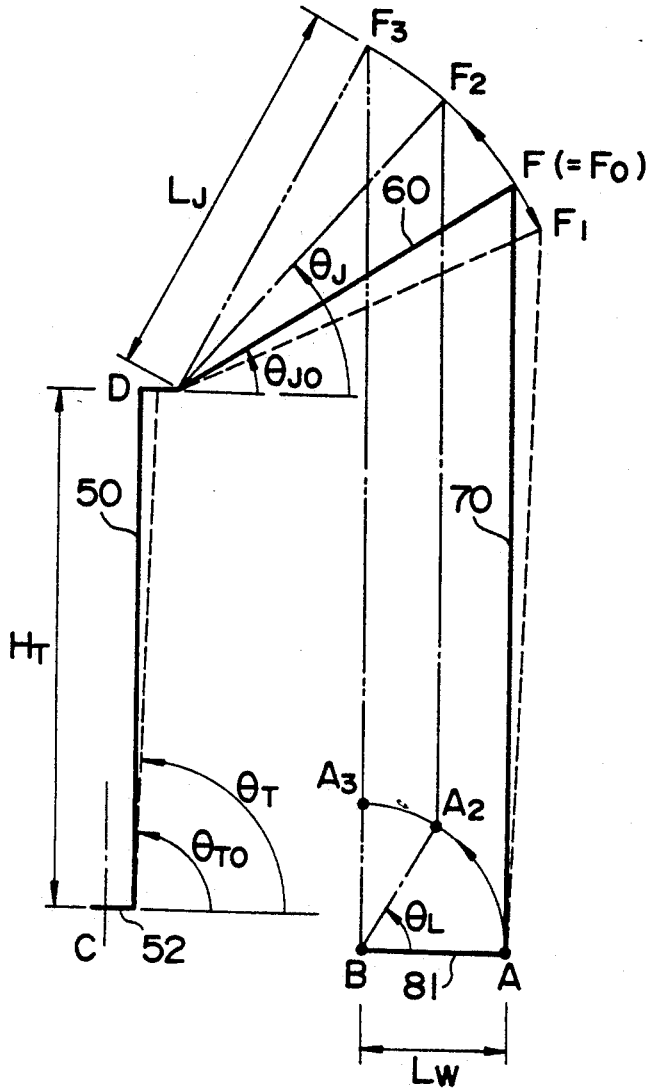
FIG. 10 is a schematic side elevational view for showing a releasing operating state of a long hanging load with a tower crane.

As shown in FIG. 10, the long hanging load 81 is hung such that its one end A is hung at the winding-up rope 70 via a hanging element such as a hook or the like. The jib 60 is supported on the upper end of the tower 50 in such a way as it may be raised and the tower 50 is fixed on the swivelling body 52 of the crane, and the swivelling body 52 is supported on the lower running body 51 around a center of swivelling C in such a way as it may be swivelled.

Figure 11:
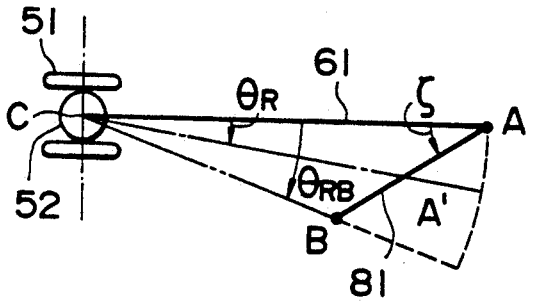
FIG. 11 is a schematic top plan view for showing a case in which the long hanging load is inclined toward a swivelling direction.

In case of releasing the aforesaid hanging load 81, it is assumed that the long hanging load 81 is inclined at an angle $\zeta$ in respect to a projecting line 61 of the jib 60 toward the ground in its swivelling direction as shown in FIG. 11 before starting the work. In this case, although it becomes necessary to perform a swivelling control in order to correct a position of the jib extreme end F in its swivelling direction when the releasing operation is carried out, an amount of correction of the position in its swivelling direction can be discriminated by a twisting angle of the winding-up rope 70 in a swivelling direction, its twisting angle can be easily seen in a rightward or leftward direction as viewed from the operator and it can be corrected by a manual operation. Accordingly, in this preferred embodiment, the twisting angle of the winding-up rope 70 as viewed from the operator is hardly seen and so a control in an aft and fro direction is performed automatically through a raising of the jib 60 and the winding-up or -down of the winding-up rope 70.

At first, before starting the releasing operation, the hanging load 81 is mounted in a forward or rearward direction as viewed from the operator, i.e. on the projecting line 61 of the jib 60 onto the ground surface, positions of both ends A and B of the hanging load 81 are acknowledged in advance by the crane, and the extreme end F of the jib 60, an extreme end hanging element of the winding-up rope 70 and one end A of the long hanging load 81 are located on the same vertical line (the initial states) as indicated by a solid line in FIG. 10. In this case, the position of one end A of the long hanging load 81 is determined in the crane by a method wherein the jib angle $\theta_{J0}$ is read at the aforesaid initial state. The position of the other end B is acknowledged by a television camera, for example, or the position of the other end B is calculated in response to the position of one end A or the hanging load length $L_W$ under the aforesaid initial state. Or the hanging element is brought just above the other end B of the hanging load and each of the states of the crane at that time is stored in the crane by other methods.

The aforesaid hanging load 81 can be released from the ground by the following three steps.

① That one end A is vertically released while the other end B of the long hanging load 81 is positioned at its specified position:

② That the long hanging load 81 is raised vertically in such a way as one end A may be positioned vertically on the the other end B while the other end B of the long hanging load 81 being positioned at its specified position:

③ That the other end B, i.e. an entire hanging load, is released in a vertical direction while one end A of the long hanging load 81 is positioned above the other end B in a vertical direction.

Each of the steps will be described in detail as follows.

① Vertical Releasing of One end A of the Hanging Load

As the winding-up of the winding-up rope 70 is carried out from its initial state indicated by a solid line in FIG. 10, a hanging load (a varying amount of the rope tension in respect to a non-loaded state) $\Delta T$ applied to the winding-up rope 70 is gradually increased to generate an extension of the jib raising rope or a flexing of the jib 60 and the jib extreme end F is displaced in a forward and downward direction from the initial position $F_0$ indicated by a solid line in FIG. 10 to the position $F_1$ indicated by a broken line in FIG. 10. At this time, the horizontal displacement amount $\Delta H_{F1}$ of the jib extreme end F in a horizontal direction and the displacement amount $\Delta Z_{F1}$ in a vertical direction can be calculated by the aforesaid equations (1) and (2).

In order to release one end A of the hanging load in a vertical direction at this step ①, it is sufficient to perform the same control as that for performing a vertical releasing of the normal around hanging load 80 described in reference to FIG. 2. That is, the horizontal displacement amount $\Delta H_{F1}$ of the jib extreme end F is always kept at 0 and the winding-up of the winding-up rope 70 and the raising of the jib 60 are carried out in such a way as the jib extreme end F is always positioned above the end A of the hanging load in a vertical direction. In order to perform this operation, at first, a winding-up or -down amount (a first target winding-up or -down amount) $L_{c1}$ of the winding-up rope 70 required for the vertical releasing of the end A of the hanging load, the raising amount (a first target raising angle) $\theta_{J1}$ of the jib 60 and a control time (a first target time) $T_{c1}$ for making $L_{c1}$ and $\theta_{J1}$ zero are preset in response to the initial state of the jib 60 or the like. The first winding-up or -down amount $L_{c1}$ of the aforesaid winding-up rope 70 is determined by the initial angle $\theta_{J0}$, and when the initial angle $\theta_{J0}$ of the jib 60 is higher than the set value, it is a positive target value for winding-up the winding-up rope 70 to increase a releasing efficiency and in turn when the initial angle $\theta_{J0}$ of the jib 60 is lower than the set value, it is a negative target value for winding-down the winding-up rope 70 so as to prevent the hanging load $\Delta T$ from being rapidly increased. The first target raising angle $\theta_{J1}$ of the jib 60 is the most appropriate value in a range where a follow-up control of the winding-up or -down of the winding-up rope 70 can be smoothly performed.

In regard to the winding-up rope 70, a required rotational speed (first target rotational speed) $\Omega_{dL1}$ of a winding-up drum is calculated in reference to the aforesaid first target winding-up or down amount $L_{c1}$ and the first target time $T_{c1}$, a feed-forward control signal corresponding to the target rotational speed $\Omega_{dL1}$ is calculated, and a driving of the winding-up drum driving device, i.e. the winding-up or -down of the winding-up rope 70, is feed-forward controlled by the signal. In turn, in regard to the jib 60, a required rotational speed (a first target rotational speed) $\Omega_{dJ1}$ of the jib raising drum is calculated in response to the aforesaid first target raising angle $\theta_{J1}$ and the first target time $T_{c1}$, a feed-forward control signal corresponding to the target rotational speed $\Omega_{dJ1}$ is calculated and then a driving of the jib raising driving device, i.e. the raising of the jib 60, is feed-forward controlled with the signal.

In addition, a result of control is sequentially approached in cooperation with the aforesaid feed-forward control and a next feed-back control is carried out. That is, in regard to the winding-up rope 70, the hanging load T is differentiated with a time (t) and a varying amount varying in time of the hanging load $\Delta T$ (a time differentiated value: $d\Delta T/dt$) is calculated and then a proportional and an integrating feed-back control are carried out in such a way as the time differentiated value $d\Delta T/dt$ may be constant, i.e. a difference between the time differentiated value and the set value may become zero. In regard to the jib 60, the horizontal displacement amount $\Delta H_{F1}$ varying in time of the jib extreme end F is calculated by the aforesaid equation (1) in response to the initial angle $\theta_{J0}$ of the jib 60 and the actual measured value to the jib angle $\theta_J$ varying in time, this horizontal displacement amount $\Delta H_{F1}$ is applied as a difference and a proportional and integrating feed-back control is carried out in such a way as its difference becomes zero.

In this way, the raising (a winding-down as required) of the winding-up roper 70 and the raising of the jib 60 are automatically controlled under a cooperative relation with mainly the feed-back control, a result of control is approached and each of them is feed-back controlled, thereby the forward horizontal displacement amount $\Delta H_{F1}$ of the jib extreme end F as the hanging load $\Delta T$ applied to the winding-up rope 70 is increased is corrected by raising the jib 60. With such an arrangement above, the jib extreme end F is corrected in such a way as it is positioned just above the end A of the hanging load in a vertical direction while the other end B of the hanging load is positioned at its specified position, and then the hanging load A is vertically released. As the hanging load $\Delta T$ applied to the winding-up rope 70 becomes constant ($d\Delta T/dt=0$), one end A of the hanging load 81 is assumed to be released from the ground and the control of the releasing operation at the step ① is completed and then the operations are transferred to the step ② .

② Vertical Raising of the Hanging Load 81

At this step ②, when only the raising of the jib 60 is carried out, the jib extreme end F is displaced in a rearward and upward direction and at the same time the extreme end A of the hanging load is also displaced in a rearward and upward direction through the winding-up rope 70. At this time, the horizontal displacement amount $\Delta H_{F2}$ and the vertical displacement amount $\Delta Z_{F2}$ of the jib extreme end F are calculated by the following equations in response to the jib angle $\theta_{J1}$ at the beginning of the step ② and the jib angle $\theta_J$ after displacement.

$$\Delta H_{F2}=L_J(\cos\theta_{J1}-\cos\theta_J) \tag{3}$$

$$\Delta Z_{F2}=L_J(\sin\theta_J-\sin\theta_{J1}) \tag{4}$$

In turn, the horizontal displacement amount $\Delta H_A$ and the vertical displacement amount $\Delta Z_A$ of the extreme end A of the hanging load 81 are calculated by the following equations in response to the hanging load length Lw and an inclination angle of the hanging load 81 in respect to the ground $\theta_L$.

$$\Delta H_A=Lw(1-\cos\theta_L) \tag{5}$$

$$\Delta Z_A=Lw.\sin\theta_L \tag{6}$$

In this case, in order to position the jib extreme end F ($=F_2$) always just above one end A ($=A_2$) of the hanging load 81 while the other end B of the long hanging load 81 is being positioned at its specified position, and further to raise the hanging load 81 vertically while the winding-up rope 70 between them is always being kept vertically, it is necessary to keep the horizontal displacement amount $\Delta H_{F2}$ of the jib extreme end F and the horizontal displacement amount $\Delta H_A$ always equal to each other. In order to attain this relation, if a relation of $\Delta H_{F2}=\Delta H_A$ is obtained, the following equations can be set in reference to the equations (3) and (5).

$$L_J(\cos\theta_{J1}-\cos\theta_J)=L_w(1-\cos\theta_L)\cos\theta_L=1-(L_J/L_w)\times(\cos\theta_{J1}-\cos\theta_J) \tag{7}$$

At this time, the required winding-up or -down amount $L_{c2}$ of the winding-up rope 70 can be calculated by the following equations.

$$\begin{aligned} L_{c2} &= \Delta Z_A-\Delta Z_{F2} \\ &= L_w\cdot\sin\theta_L-L_J(\sin\theta_J-\sin\theta_{J1}) \\ &= L_w\left[1-\left(1-\frac{L_J}{L_w}\cos\theta_{J1}-\cos\theta_J\right)^2\right]^{\frac{1}{2}}- \\ &\quad L_J(\sin\theta_J-\sin\theta_{J1}) \end{aligned} \tag{8}$$

Figure 12:
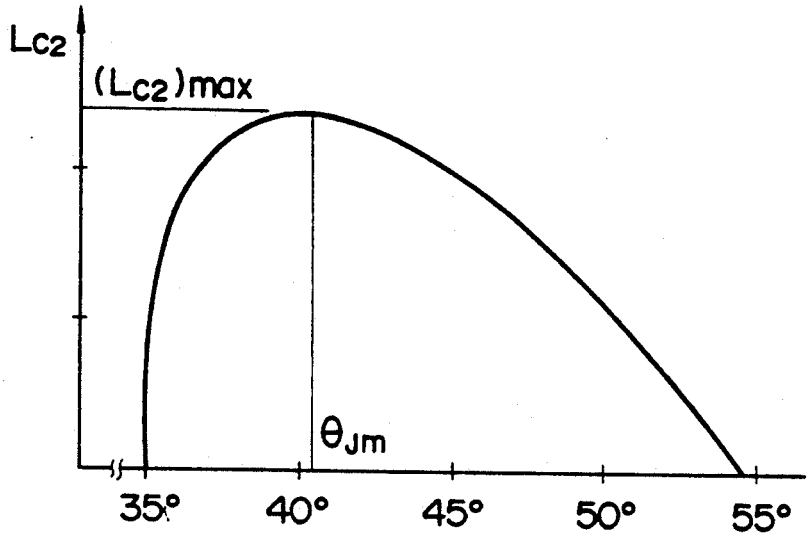
FIG. 12 is an illustrative view for showing a relation between a jib angle and a wound amount of the winding-up rope.

From the above equation (8), a relation between the jib angle $\theta_J$ and the required winding-up or -down amount $L_{c2}$ of the winding-up rope 70 in the step ② is calculated as shown in FIG. 12. In FIG. 12, the jib angle $\theta_J$ ($=\theta_{Jm}$) when the required winding-up or -down amount $L_{c2}$ of the winding-up rope 70 shows the maximum value $(L_{c2})_{max}$ is as follows.

$$\frac{\partial L_{c2}}{\partial\theta_J}=\frac{L_w\left[-1+\left(\frac{L_J}{L_w}\cos\theta_{J1}-\cos\theta_J\right)\right]\frac{L_J}{L_w}\sin\theta_J}{\left[1-\left(1-\frac{L_J}{L_w}\cos\theta_{J1}-\cos\theta_J\right)\right)^2\right]^{\frac{1}{2}}}-L_J\cos\theta_J \tag{9}$$

Accordingly, a relation of $\partial L_{c2}/\partial\theta_J=0$ is applied to get $$\theta_{Jm}=\cos^{-1}\{(L_J\cos\theta_{J1}-L_w)/(L_J-L_w)\} \tag{10}$$

Substituting the above equation (10) for the equation (8), the maximum value $(L_{c2})_{max}$ of the required winding-up or -down amount of the winding-up rope 70 in the step ② can be attained.

As apparent from FIG. 12, in order to keep the winding-up rope 70 in its vertical orientation, the winding-up of the winding-up rope 70 is carried out at the initial stage of the step ② at a high speed and in turn it is necessary to perform a slow raising of the jib 60. Thus, in respect to the winding-up drum driving device for the winding-up rope 70, a feed-forward control signal is applied in such a way as the drum rotating speed $\Omega_{dL2}$ (the second target speed) shows a controlling characteristic indicated in FIG. 13. In this case, an upper limit value $(\Omega_{dL2})_{max}$ of the drum rotational speed $\Omega_{dL2}$ is set under a feed-forward control in addition to a feed-back control value such that the feed-back control can be performed within an allowable maximum rotational speed of the winding-up drum (the maximum flow rate in case of using a hydraulic motor).

Figure 13:
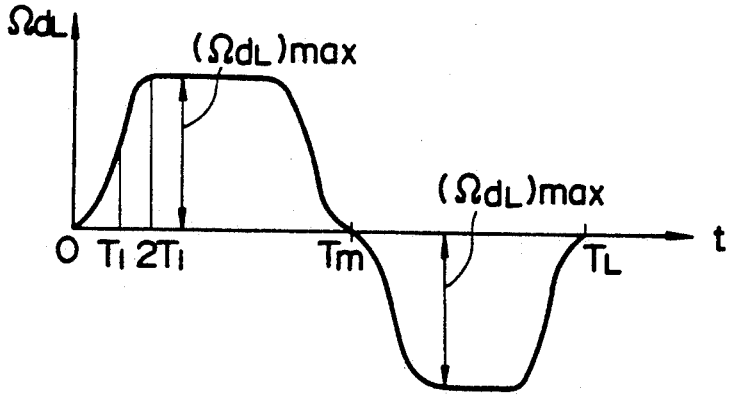
FIG. 13 is an illustrative view for showing a target rotational speed of a winding-up rope drum.

Since a relation between FIG. 12 and FIG. 13 is assumed under a winding-up of the winding-up rope 70 at the position of the jib extreme end F at the top sheeve, it is necessary that the actual rope winding-up amount at the winding-up drum position is set to a value in which a varying amount $\Delta L_C$ of the winding-up rope length from the top sheeve position to the winding-up drum as the jib angle $\theta_J$ is varied is added to the aforesaid winding-up or -down amount $L_{c2}$. This varying amount $\Delta L_c$ can be applied as a distance variation between the jib extreme end F and a pulley position at the tower top end D. The aforesaid varying amount $\Delta L_c$ is defined as a positive one for the winding-up of the winding-up rope 70 (a distance is decreased).

Figure 14:
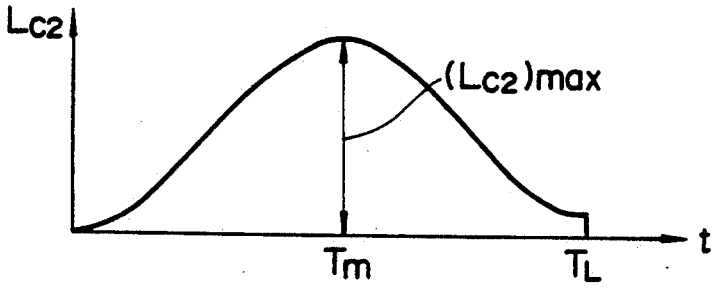
FIG. 14 is an illustrative view for showing a target winding amount of a winding-up rope.

In FIGS. 13 and 14, a former half control time Tm at the step ② can be calculated by the following equation.

$$(L_{c2})_{max} + \Delta L_c = \int_0^{Tm} \Omega_{dL2} r_{dL} d\theta_{dL2} = r_{dL}(T_m - 2T_1)(\Omega_{dL2})_{max}$$

where, $$Tm = \frac{(L_{c2})_{max} + \Delta L_c}{r_{dL}(\Omega_{dL2})_{max}} + 2T_1 \quad (11)$$

provided that $r_{dL}$ is a radius of a jib raising drum.

As apparent from FIG. 13, the winding-up rope 70 occupies a winding-up (enrolling) from a starting time 0 in the step ② to the time Tm, and in turn it occupies a winding-down (feeding-out) from the time Tm to the finishing time $T_L$ at the step ②.

Assuming the required control time $T_L$ up to the finishing of the step ②, the rope winding-up or -down amount $L_{c2}$ at the finishing time is applied as the second target winding-up or -down amount $L_{CL}$ in the same manner as that of the former half winding-up operation.

$$\{(L_{c2})_{max} - L_{CL}\} - \Delta L_c = \int_{T_m}^{T_L} \Omega_{dL2} r_{dL} d\theta_{dL2} = r_{dl}(T_L - T_m - 2T_1)(\Omega_{dL2})_{max}$$

thus, $$T_L = \frac{\{(L_{C2})_{max} - L_{CL}\} - \Delta L_C}{r_{dL}(\Omega_{dL2})_{max}} + T_m = 2T_1 \quad (12)$$

From the above equation (12), the required control time $T_L$ at the step ②, i.e. the second target time $T_{C2}$, can be attained.

In this way, since the instruction signal of the target rotational speed $\Omega_{dL2}$ of the winding-up drum at the step ② is calculated as shown in FIG. 13, some actual measured values of the rotational angle of the pulley at the top sheeve at the jib extreme end F are integrated, thereby the required amount of winding-up or -down amount $L_{c2}$ (the second target winding-up or -down amount) of the winding-up rope 70 can be calculated as shown in FIG. 14.

In order to calculate the target jib angle $\theta_{JX}$ from the required winding-up amount $L_{c2}$ at the step ②, the following equation can be attained.

$$\theta_{JX} = \sin^{-1} \frac{-AC \pm B\sqrt{A^2 + B^2 + C^2}}{A^2 + B^2} \quad (13)$$

where, $A = 2L_c 2L_J - 2L_J 2 \sin \theta_{J1}$ $B = 2L_w L_J - 2L_J^3 \cos \theta_{J1}$ $C = L_c^2 - 2L_c L_J \sin \theta - 2L_w L_J \cos \theta_{J1} - 2L_J^2$ In the above equation (13), ± denotes (+) in case that the winding-up rope 70 winds up and in turn it denotes (−) when it winds down.

Figure 15:
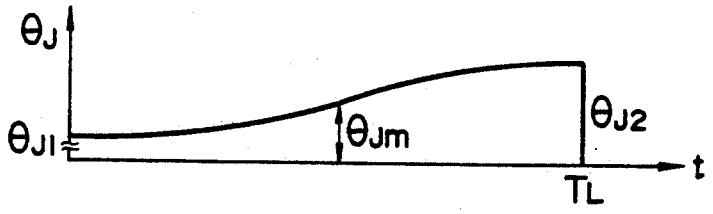
FIG. 15 is an illustrative view for showing a target inclination angle of a jib.

In reference to the equation (13), the jib angle $\theta_J$ at each of the times can be calculated as shown in FIG. 15.

Figure 16:
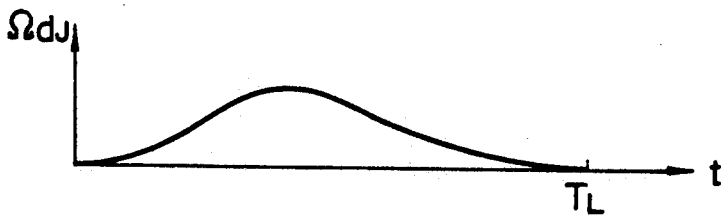
FIG. 16 is an illustrative view for showing a target rotational speed of a jib raising drum.

Differentiating the equation (13) with the time (t) enables the target rotational speed $\Omega_{dJ2}$ (a practical calculating equation is eliminated) of the jib raising drum to be attained as shown in FIG. 16.

Rope winding-up or -down amount $L_{c2}$ (=$L_{CL}$) at the final state of the step ② can be calculated by the following equations.

$$L_{CL} = L_w - L_J(\sin \theta_{J2} - \sin \theta_{J1}) \quad (14)$$

where, $$\theta_{J2} = \cos^{-1}(\cos \theta_{J1} - L_w/L_J) \quad (15)$$

In the above equations (8) to (15), the hanging load length $L_w$ is one in which a reducing amount $\Delta\Delta H$ of the horizontal displacement amount of the tower extreme end in a forward direction caused by the reduction in a falling momentum is subtracted from the hanging load length $L_w$, i.e.

$$L_w = L_w - \Delta\Delta H$$

is applied in the calculation.

As described above, the second target rotational speed $\Omega_{dL2}$ of the winding-up drum of the winding-up rope 70 and the second target rotational speed $\Omega_{dJ2}$ of the raising drum of the jib 60 are attained, so that the feed-forward control signals corresponding to these speeds are calculated and these signals are given to the winding-up drum driving device and the jib raising driving device.

In turn, at the step ②, the following feed-back control is carried out.

Since the target value of the jib angle at each of the times can be attained as shown in FIG. 15, the jib raising feed-back control is carried out in such a way that a difference between the target value and the actual measured value of the jib angle at each of the times is made zero.

In this case, when the target value of the jib angle in the feed-forward control is to be calculated, a horizontal displacement amount $\Delta H_{T2}$ of the tower 50 caused by a variation in a falling momentum of estimated value is applied. The horizontal displacement amount $\Delta H_{T2}$ can detect the varying amount $\Delta\theta_{T2}$ of the tower angle $\theta_T$. It can be calculated as $$\Delta H_{T2} = H_T \Delta\theta_{T2}$$

Accordingly, the difference $\Delta\Delta H_T$ regarding the estimated value of the horizontal displacement amount $\Delta H_{T2}$ of the tower 3 is applied to correct the target value $\theta_{JX}(t)$ of the jib angle at each of the times as follows.

$$\theta_{JC}(t) = \theta_{JX}(t) + \Delta\Delta H_T/(L_J \sin \theta_J) \quad (16)$$

is calculated and then a difference $\Delta\theta_J$ with respect to the actual measured value $\theta_J$ of the jib angle is calculated by the following equation.

$$\Delta\theta_J = \theta_{JC}(t) - \theta_J \quad (17)$$

Then, a proportional and integrating feed-back control is carried out for making this difference $\Delta\theta_J$ zero.

In turn, the feed-back control of the winding-up rope 70 is carried out as follows. The target winding-up or -down amount $L_{C2}$ at the jib extreme end position of the winding-up rope 70 at each of the times is given by the equation (8). Then, the actual measured difference $\Delta\Delta H$ in the value of $Lw(Lw-\Delta\Delta H)$ in the equation (8) is applied, the actual measured value is also applied in the jib angle $\theta_J$ to recalculate the rope winding-up or -down amount $L_{C2}$ and a feed-back control of proportional and integrating type is carried out to make a difference between the rope winding-up or -down amount $L_{C2}$ and the actual measured value $L_{CS}$ of the winding-up or -down amount which can be measured by the winding-up or -down amount sensor means such as an encoder for the top sheeve at the jib extreme end to be zero.

During the controlling operation at the step ②, since the tension of the winding-up rope 70 is required to be kept constant, a feed-back control for making a difference between $\Delta T$ and $\Delta T_2$ zero is also carried out in such a way as the value of the hanging load $\Delta T$ keeps the value $\Delta T_2$ at the starting of the step ②.

At this step ②, since the time $T_{C2}$ (the second target time) required for a controlling operation is set in advance, it is possible to discriminate the completion of the control at the step ② as the time $T_{C2}$ elapses. In addition, since the jib angle $\theta_{J2}$ at the time of completion of the step ② is calculated in advance, it is possible to provide a condition in which the measured value $\theta_J$ of the jib angle coincides with the value of $\theta_{J2}$ as a reference for the discrimination of the completion of the control. Upon completion of this control, the operation proceeds to the next step ③.

③ Vertical Releasing of the Other End B of the Hanging Load (Entire Hanging Load)

At the start-up of the step ③, one end A of the hanging load might have been placed just over the other end B under the control of the aforesaid step ②, so that in order to release the other end B in a vertical direction, it is possible to perform the feed-forward control and the feed-back control in the same manner as that of the step ①. In this case, an increased amount $\Delta T$ of the hanging load can be assumed to be approximately the same as an increased amount $\Delta T$ of the hanging load generated at the step ①. Accordingly, it is possible to estimate and set the forward displacement amount of the tower top end D and the jib extreme end F and the raising amount of the jib required for correcting the displacement amount (the third target raising amount) in response to the data applied in case of performing the control at the step ① and a more accurate feed-foward control can be attained.

In this way, after the long hanging load 81 is raised from its fallen state to its vertical state under the steps ①, ② and ③, the load is released in a vertical direction and then a displacement of the hanging load 81 or a load oscillation is prevented from occurring.

Figure 17:
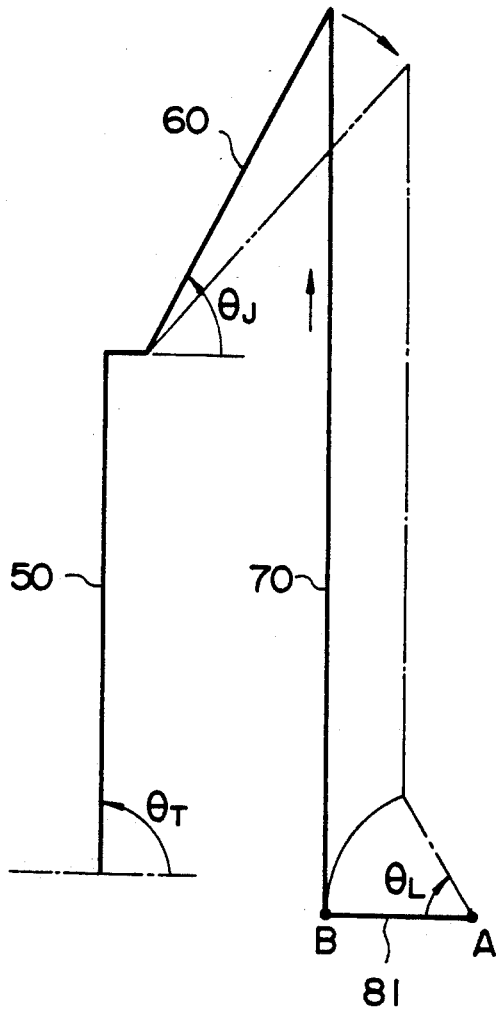
FIG. 17 is an illustrative view for showing another method for releasing a long hanging load.

FIG. 17 illustrates a case in which the long hanging load 81 is released vertically from the end part B near the tower 3 of the crane. In FIG. 17, in order to release both ends A and B of the hanging load 81 in such a way as they are released around the point A, the point A is not displaced and the winding-up rope FB (F'B') may always keep its vertical orientation, it the winding-up rope 70 is wound up while the jib 60 is being lowered and the following three-step control is carried out in the same manner as that of releasing the load while the jib 60 is being raised as described above.

①' Vertical Releasing of the Other End B of the Hanging Load

The other end B is vertically released while one end A of the hanging load 81 is being positioned at a specified position under the same control as that for releasing the point A through winding-up or -down of the winding-up rope 70 and the raising of the jib 60 at the aforesaid step ①.

②' Vertical Raising of the Hanging Load 81

The controlling method is the same as that for the jib raising under the aforesaid step ②. A different point is such that at this step ②', the winding-up rope 70 is wound up while the jib 60 is being lowered so as to prevent one end A of the hanging load 81 from being displaced, thereby the other end B of the hanging load 81 is wound up and the hanging load 81 is vertically released, resulting in that the winding-up rope 70 is always wound up. Accordingly, as the winding-up target speed, the former half portion in FIG. 13 is used. The maximum value $(L_{C2})_{max}$ of the rope winding-up amount becomes the winding-up or -down of the winding-up rope 70 at the time of completion of the step ②', the target jib angle $\theta_J(t)$ at each of the times is defined in such a way as the winding-up rope 70 keeps always its vertical orientation between $F_2$ and $B_2$ in reference to the the winding-up or -down amount $L_c(t)$ at each of the times, thereby the jib raising target speed $\Omega_{dJ}(t)$ is calculated. Other feed-forward control and feed-back control methods are the same as that of the aforesaid jib raising operation.

③' Vertical Releasing of One End A of Hanging Load (Entire Hanging Load)

This is the same as the jib raising under the aforesaid step ③ but is carried out for the releasing operation. In case that the aforesaid long hanging load 81 is vertically released, the following control device is used.

Figure 18:
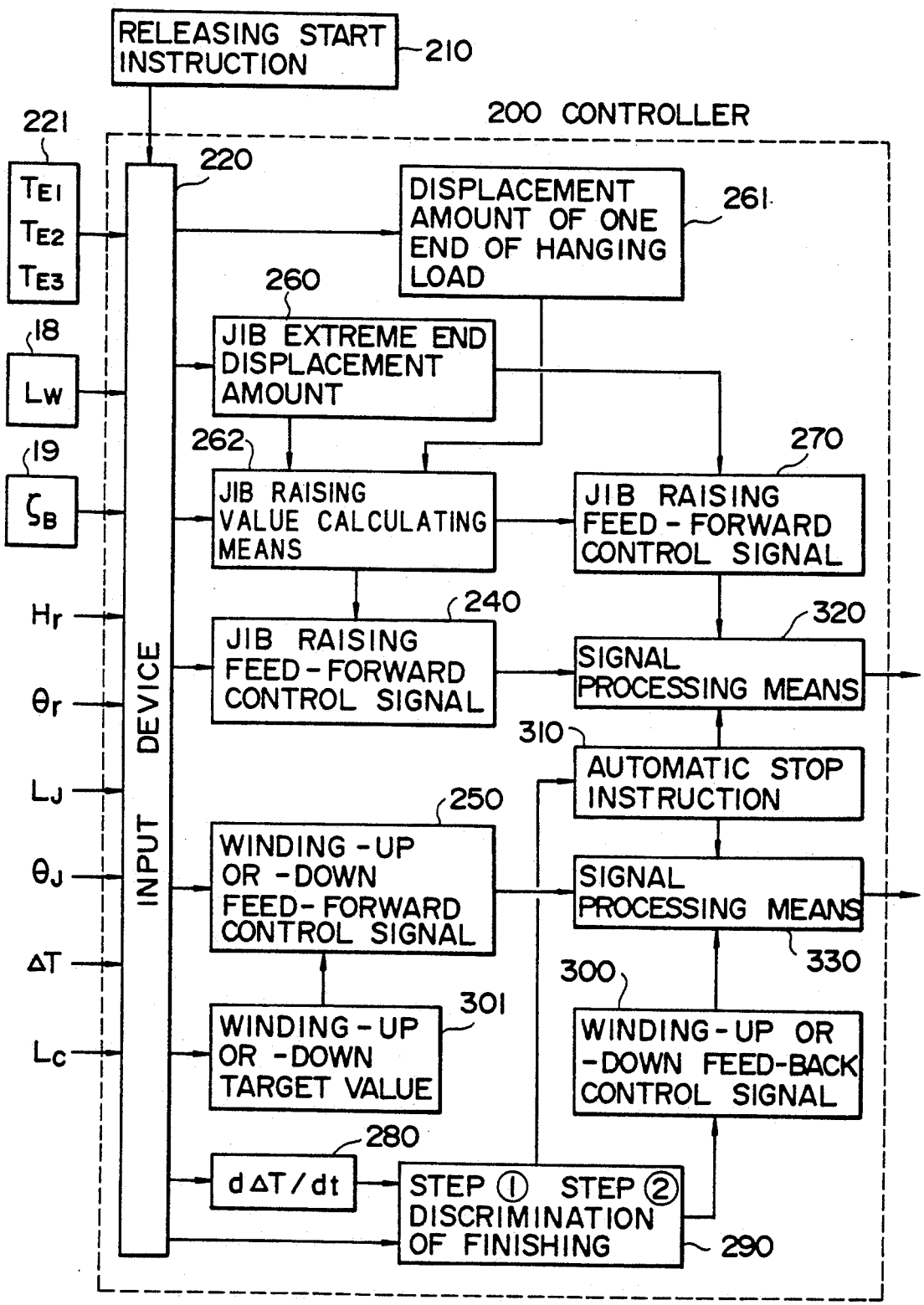
FIG. 18 is a block diagram for showing a controller part to indicate a preferred embodiment of a control device for a vertical releasing of a long hanging load.
Figure 19:
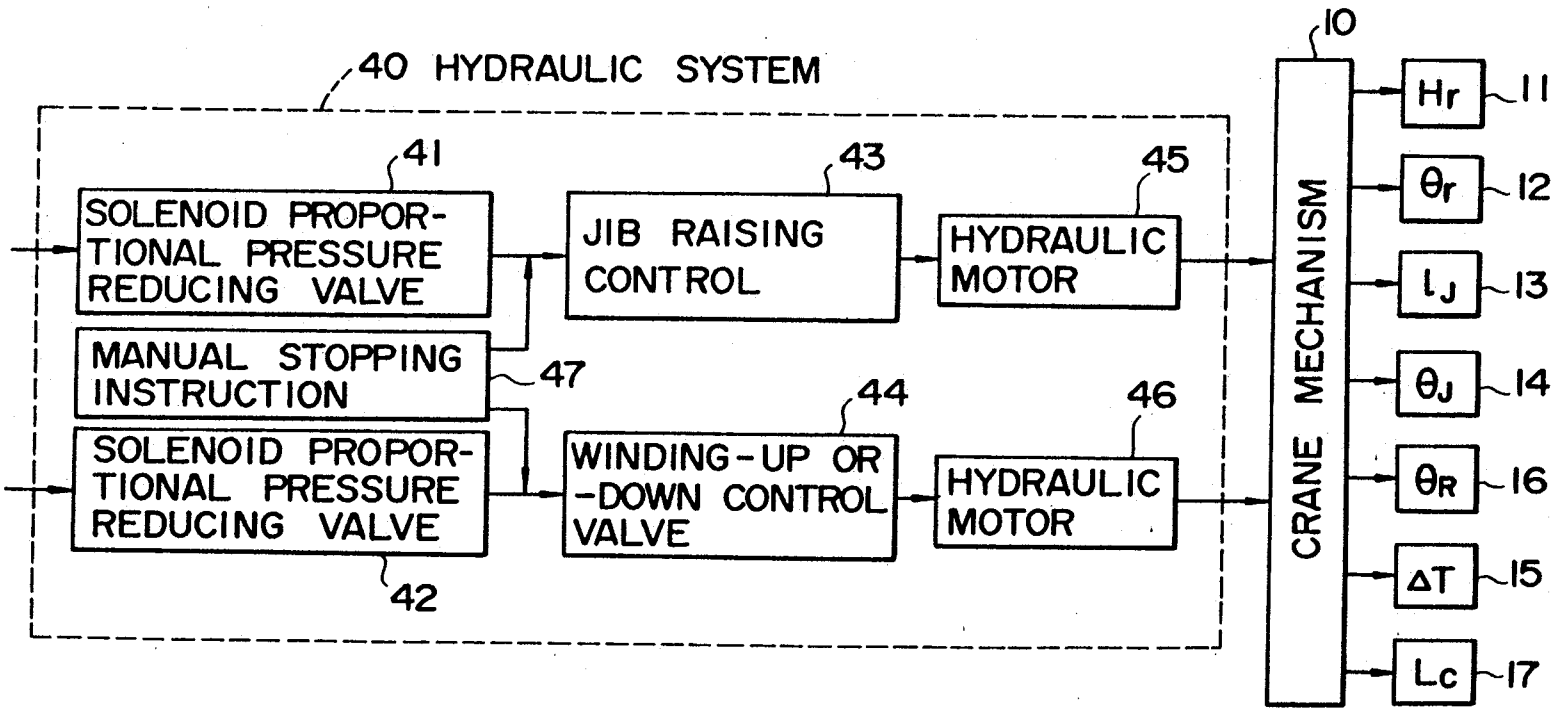
FIG. 19 is a block diagram for showing a hydraulic system to indicate a preferred embodiment of a control device for a vertical releasing of a long hanging load.

FIGS. 18 and 19 are block diagrams for showing the preferred embodiment of the control device of the present invention. The device shown in FIGS. 18 and 19 is constructed such that a part of the device shown in FIG. 1 is improved. This tower crane 10 is provided with means 16 for sensing a swivelling angle $\theta_R$ in addition to the sensor means 11 for a tower height $H_T$, there are the sensor means 12 for a tower angle $\theta_T$, the sensor means 13 for a jib length $L_J$, the sensor means 14 for a jib angle $\theta_J$ and the hanging load sensor means 15. A position of the jib extreme end F is detected by these sensor means 11 to 14 and 16.

As each of the aforesaid sensor means 11 to 16, the sensor for preventing an over-load installed in general at the crane 10 can be utilized. In addition, the tower height $H_T$ and the jib length $L_J$ may be stored in the memory device or the like in advance which is arranged in the existing over-load preventing device or the input device 220 of the controller 200.

Reference numeral 17 denotes a sensor means for detecting a winding-up or -down amount $L_c$ of the winding-up rope, reference numeral 18 denotes a sensor means for detecting a length $L_w$ of the long hanging load 81, and reference numeral 19 denotes a sensor means for detecting a hanging load mounting angle $\zeta$. Reference numeral 210 denotes a releasing start instruction means and reference numeral 221 denotes a releasing target time setting means, wherein the releasing target times $T_{E1}$, $T_{E2}$ ($T_m$, $T_L$), $T_{E3}$ of each of the aforesaid steps ①②③ are set in the setting means 221. At this time, the raising time of each of the steps and the finishing time are set in advance as required.

The tower height $H_T$, the tower angle $\theta_T$, the jib length $L_J$, the jib angle $\theta_J$, the swivelling angle $\theta_R$, the hanging load $\Delta T$, the winding-up or -down amount $L_c$ of the winding-up rope, the hanging load length $L_w$, the hanging load mounting angle $\zeta$ detected by each of the aforesaid sensor means 11 to 19 and each of the releasing target times $T_{E1}$, $T_{E2}$, $T_{E3}$ set in the releasing target time setting means 221 are inputted to the input device 220 of the controller 200.

The aforesaid three-step releasing control is carried out in response to an inputting of the releasing start instruction signal from the releasing start instruction means 210.

In this controlling operation, the jib extreme end varying amount calculation means 260 may calculate an initial position of the jib extreme end F and varying displacement amounts $\Delta H$, $\Delta Z$ at each of the times in response to the initial values of the tower height $H_T$, tower angle $\theta_T$, jib length $L_J$, jib angle $\theta_J$ (a swivelling angle $\theta_R$ as required) and varying measured values at each of the times detected by each of the aforesaid sensor means 11 to 15.

The jib raising target value calculating means 262 may calculate the first, second and third target raising amounts $\theta_{J1}$, $\theta_{J2}$, $\theta_{J3}$ of the jib corresponding to the initial state of each of the steps and each of the target rotational speeds $\Omega_{dJ1}$, $\Omega_{dJ2}$ and $\Omega_{dJ2}$ of the jib raising drum in response to the initial position of the jib extreme end F calculated by the aforesaid means 260, the hanging load length $L_w$ and each of the target control times $T_{c1}$, $T_{c2}$ and $T_{c3}$ of each of the steps ①②③ (or ①' ②' ③', same in the following description).

Jib raising feed-forward control signal calculation means 240 may calculate the feed-forward control signal corresponding to the jib raising drum target rotational speeds $\Omega_{dJ1}$, $\Omega_{dJ2}$, $\Omega_{dJ3}$ of each of the steps ①②③ calculated by the aforesaid means 262.

The jib raising feed-back control signal calculation means 270 may calculate a proportional and integrating feed-back control signal for making zero a difference $\Delta\theta_J$ between a target value $\theta_{JC}(t)$ at each of the times of the jib target raising amounts $\theta_{J1}$, $\theta_{J2}$, $\theta_{J3}$ at each of the steps ①②③ calculated by the aforesaid target value calculation means 262 and the actual measured value $\theta_J$ of the jib angle.

In turn, the winding-up or -down target value calculation means 301 may calculate the first, second and third target winding-up or -down amounts of the winding-up rope 70 in response to the initial states of each of the steps and the target rotational speeds $\Omega_{dL1}$, $\Omega_{dL2}$, $\Omega_{dL3}$ of the winding-up drum in response to the target control times $T_{E1}$, $T_{E2}$, $T_{E3}$ of each of the steps ① ② ③ as well as the hanging load length $L_w$.

The feed-forward control signal calculation means 250 for winding-up or -down the winding-up rope may calculate the feed-forward control signal corresponding to the target rotational speed $\Omega_{dL1}$, $\Omega_{dL2}$, $\Omega_{dL3}$ of the winding-up drum calculated by the aforesaid means 301 for every step ①②③.

The feed-back control signal calculation means 300 for winding-up or -down the winding-up rope may calculate the feed-back control signal for making 0 of a difference between the time differentiated value and the set value in order to make a time differentiated value ($d\Delta T/dt$) of the hanging load $\Delta T$ constant at each of the steps ①②③, and further at the step ②, it may also calculate the feed-back control signal for making a variation of the winding-up or -down amount of the winding-up rope 70 constant.

The discriminating means 290 may discriminate whether the time differentiated value ($d\Delta T/dt$) at the steps ① and ③ is constant or not in response to the aforesaid time differentiated value ($d\Delta T/dt$) and the target control times $T_{E1}$, $T_{E2}$, $T_{E3}$ and if the time differentiated value becomes constant, it may judge that the controls at the steps ① and ③ are completed and then it may instruct each of the aforesaid calculation means 240, 270, 250 and 300 a completion of the step ① and a control start instruction of the step ② as well as a completion of the step ③, respectively. The control completion time of the step ② can be discriminated as the target control time $T_{E2}$ elapses from the start instruction at the step ② by the discrimination means 34.

The feed-forward control signal and the feed-back control signal calculated by each of the aforesaid calculation means 240, 270, 250 and 300 for each of the aforesaid steps ①②③ are sent to the solenoid proportional pressure reducing valves 41 and 42 through the signal processing means 320 and 330. The solenoid proportional pressure reducing valves 41 and 42 may output the pilot pressures corresponding to the aforesaid signals, the jib raising control valve 43 and the winding-up or -down control valve 44 are changed over to a raising side or a descending side with the pilot pressures and at the same time a degree of spool is controlled, a rotation of each of the hydraulic motors 45 and 46 is controlled, the jib raising and a winding-up or -down control for the winding-up rope are carried out in an order to the aforesaid steps ①②③ and then the long hanging load 81 is released vertically after it is raised in a vertical direction from its fallen state.

In the aforesaid control, if the manual stop instruction means 47 such an operating lever for a pilot valve connected to a pilot pipe line for changing-over each of the control valves 43 and 44 is operated, the aforesaid control is immediately cancelled, each of the control valves 43 and 44 is operated to a neutral position or a danger avoiding state in response to the operation of the aforesaid means 47 under a priority of manual operation and the motors 45 and 46 are stopped or operated toward the danger avoiding direction. With such an arrangement, its safety characteristic is assured.

In case that the aforesaid long hanging load 81 is released in a vertical direction, it may not only be limited to the tower crane in the aforesaid preferred embodiment but also it may be controlled by using a normal jib crane or a rafteren crane having an extendable or retractable boom or the like. In case of the crane using the boom, a control over the raising of the boom may be carried out in place of a raising control of the jib in the aforesaid preferred embodiment. In this case, the raising control of the boom may be carried out by applying a hydraulic motor and a raising rope or a control of the extending or retracting of a hydraulic cylinder and in any case, it may be accommodated substantially in the same manner as that of the control for the aforesaid preferred embodiments.

We claim:

1. A hanging load raising control device for controlling the raising of a hanging load as the hanging load is released from the ground, in a crane including a jib which can be raised and lowered, a jib raising and lowering driving device, a hanging load winding-up rope and a winding-up and -down driving device for the winding-up rope, comprising:

a sensor means for sensing a position of a jib extreme end;

a sensor means for sensing a weight of a hanging load;

a releasing control start instruction means;

a target value calculation means for calculating a target value of a jib raising speed and a target value of a winding-up and -down speed of a winding-up rope in response to an initial value of the position of the extreme end of the jib detected by the jib extreme end position sensing means in response to a signal from said releasing control start instruction;

first calculation means for outputting a jib raising feed-forward control signal based on the jib raising speed target value calculated by said target value calculation means;

second calculation means for outputting a feed-forward control signal for winding-up and -down of the winding-up rope in response to the winding-up and -down speed target value of the winding-up rope calculated by said target value calculation means;

third calculation means for calculating a displacement amount of a position of the jib extreme end in response to a detected value from the jib extreme end position sensing means, for defining the displacement amount as a difference, and for outputting a feed-back control signal for controlling the jib extreme end in such a way that said difference becomes zero;

fourth calculation means for calculating a varying amount per unit time of a hanging load in response to a detected value of said hanging load sensing means and outputting a feed-back control signal for winding-up and -down the winding-up rope in such a way as a difference between the varying amount and a set value of the hanging load becomes zero; and control means for controlling a driving of a jib raising and lowering driving device and a driving device for winding-up and -down the winding-up rope in response to a control signal outputted from each of said calculation means.

2. A vertical releasing control device for a hanging load in a crane according to claim (1) in which the sensor means for the position of the jib extreme end has a jib angle sensor, said target value calculation means comprises means for calculating a winding-up speed target value for winding-up the winding-up rope at a speed corresponding to the initial value of the jib angle when the initial value of the jib angle detected by the jib angle sensor is higher than the set value, and means for calculating a winding down speed target value for winding-down the winding-up rope at a speed corresponding to the initial value of the jib angle when the initial value is less than the set value.

3. A vertical releasing control device for a hanging load in a crane according to claim (1) or (2) including signal processing means for restricting a maximum value and a minimum value of each of the feed-forward control signals outputted from said first calculation means and said second calculation means.

4. A vertical releasing control device for a hanging load in a crane according to any one of claims (1) or (2) including signal processing means for gradually increasing a raising pattern of each of the feed-forward control signals outputted from said first and second calculation means within a set time from a reference value to a target control value, respectively.

5. A vertical releasing control device for a hanging load in a crane according to claim (1) including a differentiator means for time differentiating a variation of a hanging load detected by said hanging load sensor means, a releasing completion discrimination means for discriminating that a releasing control is finished in response to determining that the time differentiating value is within the setting range, and a control stop instruction means for outputting a control stop signal for each of said driving devices in response to a finishing signal from the discrimination means.

6. A vertical releases control device for a hanging load according to claim (5) including signal processing means for gradually decreasing a control signal for each of said driving devices from a control value to a reference value within a setting time in response to a control stop signal from said control stop instruction signal.

7. A vertical releasing control device for a hanging load according to one of claims (1) or (6) wherein said jib is supported on an upper end of a tower in such a way that said jib may be raised or lowered, wherein the sensor means for detecting a position of a jib extreme end includes sensors for a tower height, a tower angle, a jib length and a jib angle.

8. A vertical releasing control device for a hanging load according to claim (7) in which said jib raising and lowering driving device has a hydraulic motor for driving a winding-up drum for a jib raising and lowering rope, the winding-up rope winding-up and-down driving device has a hydraulic motor for driving a winding-up drum for the winding-up rope, and said control means is provided with a control valve for controlling a flowing flow rate of hydraulic oil from a hydraulic source to each of the hydraulic motors and with a solenoid proportional pressure reducing valve for outputting a hydraulic signal for controlling a changing-over of each of the control valves in response to each of said control signals.

9. A vertical releasing control device for a crane according to claim (1) wherein said jib is a boom supported on an upper swivelling body of the crane in such a way that said jib may be raised and lowered, and wherein the sensor means for detecting a position of said jib extreme end is comprised of a boom length sensor and a boom angle sensor.

10. A vertical releasing control device for a crane according to claim (9) in which said jib raising and lowering driving device has a boom raising or lowering hydraulic cylinder, the winding-up rope winding-up and-down driving device has a hydraulic motor for driving the take-up drum for the winding-up rope and is provided with a control valve for controlling a flowing flow rate of hydraulic oil from a hydraulic source to said hydraulic cylinder and the hydraulic motor and with a solenoid proportional pressure reducing valve for outputting a hydraulic signal for changing-over control for each of the control valves in response to said control signal.

11. A vertical raising control device for controlling the raising of a hanging load as the hanging load is released from the ground, in a crane, comprising:

means for calculating a first winding-up and down amount of a winding-up rope in a first step for vertically releasing one end of a long hanging load while the other end thereof is positioned at a specified position, for calculating a second winding-up and -down amount of the winding-up rope in a second step for raising the one of the long hanging load in a vertical direction while the other end thereof is positioned at a specified position after a completion of the first step, and for calculating a third winding-up and -down amount of the winding-up rope in a third step for releasing the other end of the long hanging load while the one end thereof is positioned vertically above the other end after a completion of the second step, jib raising and lowering amount calculation means for calculating a first raising and lowering amount of the jib for correcting a displacement of the jib extreme end caused by a flexing of the jib during said first step and positioning the jib extreme end vertically over the one end of the long hanging load, for calculating a second raising and lowering amount of the jib for horizontally displacing the jib extreme and during the second step from the one end of the long hanging load to the other end thereof, and for calculating a third raising and lowering amount of the jib for correcting a displacement of the jib extreme end caused by the flexing of the jib during the third step and so positioning the jib extreme end vertically over the other end of the load, and a winding-up rope winding-up and -down control means for controlling a winding-up and -down driving device in response to each of the first, second and third winding-up and -down amounts calculated by said winding-up and -down amount calculating means, and a jib raising and lowering control means for controlling a jib raising and lowering driving device for the jib in response to each of the first, second and third raising and lowering amounts calculated by said jib raising and lowering amount calculation means.

* * * * *